US005409060A

United States Patent [19]

Carter

[11] Patent Number: 5,409,060

[45] Date of Patent: Apr. 25, 1995

[54] WELLBORE TOOL ORIENTATION

[75] Inventor: Thurman B. Carter, Pearland, Tex.

[73] Assignee: Weatherford U.S., Inc., Houston, Tex.

[21] Appl. No.: 225,384

[22] Filed: Apr. 4, 1994

Related U.S. Application Data

[63] Continuation of Ser. No. 119,813, Sep. 10, 1993.

[51] Int. Cl.[6] ..... E21B 7/08; E21B 23/00; E21B 31/18

[52] U.S. Cl. ..... 166/237; 166/206; 166/117.5; 166/117.6; 166/241.1

[58] Field of Search ..... 166/241.1, 241.5, 237, 166/240, 206, 217, 123, 125; 294/86.26, 86.32

[56] References Cited

U.S. PATENT DOCUMENTS

| | | | |
|---|---|---|---|
| 1,570,518 | 1/1926 | Mitchell | 166/117.6 X |
| 1,589,399 | 6/1926 | Kinzbach . | |
| 1,804,819 | 5/1931 | Spencer, Jr. et al. | 166/117.6 X |
| 1,812,880 | 7/1931 | Kinzbach et al. | 166/117.6 |
| 1,816,856 | 8/1931 | Kinzbach et al. | 255/1 |
| 1,835,227 | 12/1931 | Lane et al. . | |
| 1,866,087 | 7/1932 | Crowell . | |
| 1,869,759 | 8/1932 | Lynch . | |
| 2,014,805 | 9/1935 | Hinderliter . | |
| 2,065,896 | 12/1936 | Keever . | |
| 2,101,185 | 12/1937 | Monroe . | |
| 2,103,622 | 12/1937 | Kinzbach . | |
| 2,105,721 | 1/1938 | Cutrer et al. . | |
| 2,105,722 | 1/1938 | Barrett et al. | 175/81 |
| 2,132,061 | 10/1938 | Walker | 166/117.6 |
| 2,170,284 | 8/1939 | Eastman | 166/117.6 |
| 2,207,920 | 7/1940 | Hughes | 175/81 |
| 2,227,347 | 12/1940 | Johnson | 175/82 X |
| 2,298,706 | 10/1942 | Kothny . | |
| 2,324,682 | 7/1943 | DeLong | 166/117.6 |
| 2,331,293 | 10/1943 | Ballard | 166/117.5 |
| 2,445,100 | 7/1948 | Wright | 166/117.6 |
| 2,495,439 | 1/1950 | Brinble | 175/81 |
| 2,567,507 | 9/1951 | Brown | 166/117.5 |
| 2,586,878 | 2/1952 | Staton . | |
| 2,633,331 | 3/1953 | Hampton | 255/1.6 |
| 2,664,162 | 12/1953 | Howard et al. | 116/117.5 |
| 2,699,920 | 1/1955 | Zublin | 166/117.6 |
| 2,770,444 | 11/1956 | Neal | 166/117.6 |
| 2,775,306 | 12/1956 | Middleton et al. | 166/125 X |

(List continued on next page.)

FOREIGN PATENT DOCUMENTS

| | | |
|---|---|---|
| 93/00684 | 8/1993 | European Pat. Off. . |
| 727897 | 4/1955 | United Kingdom . |
| 93/02504 | 3/1994 | WIPO . |

OTHER PUBLICATIONS

"Kinzbach Tool Co., Inc. Catalog 1958–1959," Kinzbach Tool Company, Inc., 1958; see pp. 3–5 particularly.

(List continued on next page.)

*Primary Examiner*—Stephen J. Novosad
*Attorney, Agent, or Firm*—Guy McClung

[57] ABSTRACT

The present invention includes, in one embodiment, a receptacle for use in orienting a tool or member in a wellbore or in a tubular with respect to an anchor (or other member) anchored in the wellbore or tubular. In one aspect the receptacle has hollow cylindrical body with a tapered nose and a lower alignment assembly in a bottom of the hollow body member. The lower alignment assembly receives and releasably holds a top portion of the anchor and facilitates its movement through and orientation with respect to the receptacle. In one aspect the receptacle also includes an upper locking assembly which receives and locks onto the anchor. An anchor according to this invention has a guide key according to this invention with dual opposed carved surfaces which co-act with curved surfaces on the tapered nose of the receptacle's body to facilitate movement of the receptacle in a correct orientation down over the top to the anchor. A survey tool according to this invention has an orientation indicating device secured to an orientation assembly according to the invention. A split lock ring according to the invention has a lower inclined surface on a body thereof to enhance locking engagement force.

19 Claims, 24 Drawing Sheets

U.S. PATENT DOCUMENTS

| | | | |
|---|---|---|---|
| 2,797,893 | 7/1957 | McCune et al. | 175/79 |
| 2,882,015 | 4/1959 | Beck . | |
| 2,950,900 | 8/1960 | Wynes | 175/61 |
| 2,976,931 | 3/1961 | Daffin | 166/125 |
| 3,000,440 | 9/1961 | Malcomb | 166/4 |
| 3,075,583 | 1/1963 | Nielsen | 166/117.5 |
| 3,095,039 | 6/1963 | Kinzbach | 166/117.6 |
| 3,096,824 | 7/1963 | Brown | 166/210 |
| 3,116,799 | 1/1964 | Lemons | 175/61 |
| 3,172,488 | 3/1965 | Roxstrom | 175/81 |
| 3,194,594 | 7/1965 | Hagler | 166/125 X |
| 3,248,129 | 4/1966 | Brown | 166/240 X |
| 3,667,252 | 6/1972 | Nelson | 64/23.5 |
| 3,908,759 | 9/1975 | Cagle et al. | 166/117.6 |
| 4,007,797 | 2/1977 | Jeter | 175/26 |
| 4,101,157 | 7/1978 | Richey | 166/240 X |
| 4,135,577 | 1/1979 | Nelson et al. | 166/241.1 |
| 4,153,109 | 5/1979 | Szescila | 166/250 |
| 4,266,621 | 5/1981 | Brock | 175/329 |
| 4,273,464 | 6/1981 | Scott | 166/240 X |
| 4,285,399 | 8/1981 | Holland et al. | 166/113 |
| 4,304,299 | 12/1981 | Holland et al. | 166/255 |
| 4,307,780 | 12/1981 | Curington | 166/113 |
| 4,397,360 | 8/1983 | Schmidt | 175/61 |
| 4,429,741 | 2/1984 | Hyland | 166/63 |
| 4,450,912 | 5/1984 | Callihan et al. | 166/289 |
| 4,491,178 | 1/1985 | Terrell et al. | 166/192 |
| 4,550,781 | 11/1985 | Kagler et al. | 166/340 |
| 4,646,826 | 3/1987 | Bailey et al. | 166/55.3 |
| 4,665,995 | 5/1987 | Braithwaite et al. | 175/45 |
| 4,765,404 | 8/1988 | Bailey et al. | 166/117.6 |
| 4,807,704 | 2/1989 | Hsu et al. | 166/313 |
| 4,844,167 | 7/1989 | Clark | 175/4.53 |
| 4,938,291 | 7/1990 | Lynde et al. | 116/55.8 |
| 4,984,488 | 1/1991 | Lunde et al. | 76/115 |
| 5,014,778 | 5/1991 | Lynde et al. | 166/55.6 |
| 5,086,838 | 2/1992 | Cassel et al. | 166/55.6 |
| 5,109,924 | 5/1992 | Jurgens et al. | 166/117.5 |
| 5,113,938 | 5/1992 | Clayton | 166/117.6 |
| 5,115,872 | 5/1992 | Brunet et al. | 175/61 |
| 5,154,231 | 10/1992 | Bailey et al. | 166/298 |
| 5,163,522 | 11/1992 | Eaton et al. | 175/58 |
| 5,195,591 | 3/1993 | Blount et al. | 166/380 |
| 5,211,715 | 5/1993 | Braden et al. | 175/58 |
| 5,222,554 | 6/1993 | Blount et al. | 166/117.6 |
| 5,253,710 | 10/1993 | Carter et al. | 166/298 |
| 5,265,675 | 11/1993 | Hearn et al. | 166/297 |
| 5,277,251 | 1/1994 | Blount et al. | 166/117.5 |
| 5,287,921 | 2/1994 | Blount et al. | 166/117.6 |
| 5,287,922 | 2/1994 | Bridges | 166/277 |
| 5,318,121 | 6/1994 | Brockman | 166/313 |
| 5,318,122 | 6/1994 | Murray et al. | 166/313 |
| 5,322,127 | 6/1994 | McNair et al. | 166/313 |
| 5,335,737 | 8/1994 | Baugh | 175/61 |
| 5,341,873 | 8/1994 | Carter et al. | 166/117.5 |
| 5,346,017 | 9/1994 | Blount et al. | 166/380 |

OTHER PUBLICATIONS

"Dual horizontal extension drilled using retrievable whipstock," Cress et al, Worked Oil, Jun. 1993, five pages.

"Casing Whipstocks," Eastman Whipstock, Composite Catalog, p. 2226, 1976–1977.

"Bowen Whipstocks," Bowen Oil Tools, Composite Catalog, one page, 1962–1963.

"Improved Casing Sidetrack Procedure Now Cuts Wider, Larger Windows," Cagle et al, Petroleum Engineer International, Mar. 1979.

"Weatherford Fishing and Rental tool Services," 1993.

"A-1 Bit & Tool company" 1990–01 General Catalog, pp. 8, 14.

Frank's, "The Submudline Drivepipe Whipstock, U.S. Pat. No. 4,733,732".

WELLBORE TOOL ORIENTATION

RELATED APPLICATION

This is a continuation-in-part of U.S. application Ser. No. 08/119,813 filed on Sep. 10, 1993 entitled "Whipstock System".

BACKGROUND OF THE INVENTION

1. Field of the Invention

The present invention is related to: receptacles for wellbore anchors; keys for such anchors; anchors with such keys; stabilizers for whipstocks; standoff and support apparatus for wellbore tool members, e.g. a concave member of a whipstock; whipstocks and associated apparatus for use in wellbores; locking assemblies, both releasable and permanent, for locking into wellbore tools; whipstocks insertable through one tubular into another, e.g. through smaller tubing into larger casing; whipstock installation tools; survey tool assemblies; whipstock apparatus which can be set by pulling upwardly thereon; and to anchoring apparatus for use in tubulars. In certain aspects these items or combinations of them are insertable through a smaller diameter tubular, e.g. tubing, into a tubular of larger diameter, e.g. casing.

2. Description of Related Art

A variety of "through tubing" whipstocks and tools insertable through tubing are available in the prior art; e.g. the devices disclosed in U.S. Pat. Nos. 5,287,921; 5,265,675; 5,277,251; 5,222,554; 5,211,715; 5,195,591; and 4,491,178.

There is a need for the stabilization of a whipstock concave member disposed in a wellbore during milling operations. There is a need for an effective whipstock and associated apparatus which is insertable through a smaller diameter tubular, such as tubing, and then disposable in a larger diameter tubular, such as casing, below the smaller diameter tubular. There is a need for such devices which effectively anchor and correctly orient themselves in the larger diameter tubular. There is a need for an efficient and effective orientation apparatus for wellbore tools and for an anchor for effective use with such orientation apparatus. There is a need for such an orientation apparatus which is re-settable if correct orientation is not initially achieved.

SUMMARY OF THE PRESENT INVENTION

The present invention in one embodiment discloses an orientation apparatus for wellbore tools, the apparatus having a receptacle for a wellbore anchor, the receptacle having a tapered nose with curved surfaces for contacting one of two opposed curved surfaces of a key on the anchor. In one aspect such a receptacle is used with an anchor receiving member in a two stage method-a first releasable holding stage and a second non-releasable locking stage. In one aspect the receptacle's and key's curved surfaces are configured so that following contact at any point along the receptacle's curved surface by either of the key's curved surfaces, the receptacle and anchor move into a correct orientation with respect to each other and then a stinger on the anchor moves into upper locking apparatus which non-releasably grip and lock the stinger in place. In one aspect, releasable gripping apparatus is used in the lower alignment assembly and after the stinger has entered a lower alignment assembly in the receptacle, but has not yet entered the upper locking apparatus, the orientation assembly is still releasable from the stinger (and anchor) by pulling up on the orientation assembly. The orientation assembly need not be raised and removed from the wellbore to attempt again to achieve correct tool setting and orientation. The orientation assembly needs only to be separated from the anchor and then re-lowered to proceed with engagement of the stinger and its associated anchor. Such an orientation assembly is insertable through a tubular of small diameter into a tubular of larger diameter for use therein.

In one embodiment the present invention discloses a wellbore anchor with a body, anchoring apparatus for anchoring the anchor in the wellbore, and a guide key on the body, the guide key having opposed curved surfaces which meet along a line at a tip of the key, the curved surfaces configured and disposed to contact and co-act with corresponding curved surfaces on a receptacle moving down to encounter the anchor. In one aspect such a guide key is relatively more massive than a circular pin or cylindrical member typically used to facilitate such co-action between a receptacle and an anchor. The guide then can be formed integrally of or secured to a body of an anchor. Such anchors according to this invention may be designed, configured, and sized to be insertable through a tubular or tubular string, e.g. but not limited to tubing, of relatively small inner diameter prior to activation so that they can be moved through the tubular into a tubular of larger diameter in which the tubular of smaller diameter is positioned. The guide key secured to an anchor body can be secured with a bolt or pin (and have a corresponding hole therethrough for such securement), or it can be bonded or molded to the anchor body. In one aspect a guide key according to this invention has a base which includes a portion below the opposed curved surfaces. The base fits into a corresponding slot or recess in the anchor body for stabilization of the key in place with respect to the anchor body. This invention includes such guide keys, anchors with such a key, and designs for both.

In one embodiment the present invention discloses a lower alignment assembly for use with a receptacle of an orientation apparatus which facilitates reception into the receptacle of another member, including but not limited to a part of a wellbore anchor (e.g. a stinger) thereof. In one aspect such a lower alignment assembly moves with the other member as it approaches and then co-acts with additional gripping, locking, and/or alignment apparatus in the receptacle. In one aspect such a lower alignment assembly has releasable gripping apparatus which releasably grips the other member and releases the member (e.g. an anchor stinger) in response to pulling up on the receptacle.

In one embodiment the present invention discloses a standoff or support apparatus for a wellbore tool. Such apparatus is useful to maintain a position of a wellbore tool and/or to provide a member against which a force can act without unwanted movement of the member upon which the force acts. In one aspect such apparatus includes a releasable pin extending through the body of a wellbore tool and a pad on the pin. Upon release of the pin, the pin moves away from the tool so that the pad contacts the interior surface of the wellbore or of a tubular in which the tool is disposed, e.g. casing. Locking apparatus prevent the pin from returning into the tool. In another embodiment a first toothed bar is movably disposed with respect to a second toothed bar secured to a wellbore tool. Release of the first toothed bar and its upward movement forces the second toothed bar outwardly away from the tool to contact an interior surface of a wellbore or tubular. Appropriate apparatus is used to prevent the second bar from moving back toward the tool; e.g. but not limited to ratcheting teeth on the opposed bars or teeth configured with flat bases which meet and then prevent bar movement. In one aspect such standoff or support apparatus is useful with a concave member of a whipstock disposed in a casing and is insertable through a tubing string extending down into the casing to exit the tubing for activation in casing below the bottom end of the tubing string.

In one embodiment of the present invention one or more standoff or support apparatuses according to the present invention are used with a member (including but not limited to a flat bar, a solid or hollow tubular, part of a whipstock assembly, or a whipstock concave member) to anchor the member in place in a wellbore or in a tubular member (such as casing, drill pipe, or tubing). By employing one or more standoff or support apparatus according to the present invention such a member may be oriented at a desired angle with respect to a wellbore and/or other tubular in which the member is disposed. In one aspect such a member with an appropriate series of standoff or support apparatuses (including but not limited to a combination of different apparatuses disclosed here) may be used without a typical wellbore anchor, without (and in place of) a typical whipstock concave member, and/or without a typical whipstock assembly for directional drilling operations and/or directional milling operations.

The present invention, in one embodiment, discloses a whipstock system having an orientation device; a flexion member releasably secured to the orientation device; co-acting lower and upper body members, the lower body member interconnected with the flexion member; a connecting bar which connects the upper and lower body members permitting the upper body member to move downwardly with respect to the lower body member while preventing separation of the two body members; and a concave member secured to and above the upper body member. In one preferred embodiment, one or more movable pawls on the connecting bar move to engage surfaces on one or both body members to prevent upward movement of the upper body member with respect to the lower body member, or conversely movement of the lower body member downwardly away from the upper body member; and movement of the one or more pawls in contact with both body members also forces the two body members apart further stabilizing the system in a tubular.

In one embodiment of such apparatus, movement of the lower body member sideways up against a casing wall for frictional engagement therewith is facilitated by the use of a notched tube connected between the lower body member and the flexion member. The flexion member itself further facilitates such movement of the lower body member since it, preferably, has a reduced area neck which enhances flexing of the flexion member. To enhance frictional contact of the lower body member with the casing, one or more friction members or pads, or toothed slip members can be provided on the exterior of the lower body member which move to contact and frictionally engage the casing's interior surface as the lower body member moves against the casing. One or more toothed members or toothed slips may be used and teeth on different members or slips may be oriented differently; e.g. on one slip teeth may be oriented downwardly to prevent downward movement of the device and on another slip teeth may be oriented upwardly to engage e.g. a casing to prevent upward movement. Initially the total effective largest dimension of the two body members is sufficiently small that they are insertable through a tubular (e.g. tubing) of a relatively small diameter. Then as they move apart with respect to each other the total effective largest dimension of the two body members increases so that one or both engage the interior of a relatively larger diameter tubular (e.g. casing) in which the smaller diameter tubular is positioned.

In one embodiment the connecting bar has an I-shaped cross-section and the upper and lower body members each have a groove with a corresponding shape for receiving part of the connecting bar. Thus the connecting bar prevents the two body members from separating or rotating with respect to each other while at the same time allowing the upper body member to move downwardly adjacent the lower body member permitting the two to move sideways to a controlled extent with respect to each other. Preferably the upper and lower body members are disposed at an angle to each other and the connecting bar is configured and the associated body member grooves are disposed so that as the upper body member moves downwardly with respect to the lower body member, the lower body member contacts and frictionally engages one interior side of the casing and the upper body member moves to contact the other side of the casing's interior; thus stabilizing the apparatus in place. At this point an upward force may be applied to the apparatus, causing the pawls to lock the lower and upper body members together, preferably pushing them slightly farther apart to further stabilize them in place and setting the whipstock in place at the desired location. Further pulling frees any upper setting tool or installation tool, leaving the whipstock correctly positioned.

Appropriate orienting devices are used so that the concave member is correctly oriented with respect to the wellbore to direct a milling tool in a desired direction. Correct orientation of the whipstock system with respect to an anchor in the casing is facilitated in certain preferred embodiments by an installation tool secured to the top of the concave member. The installation tool has a mandrel secured to the concave member, the mandrel rotatable within an upper housing which is itself secured to an upper sub which is threadedly connected to the tool string from which the whipstock is suspended. Preferably the installation tool does not transmit torque to apparatus below it due to the mandrel's rotation. The orienting device at the bottom of the whipstock system may include a scooped receptacle which rotates to correctly orient with respect to and to engage an anchor disposed in the casing.

In one embodiment friction reducing members, substances, or pads may be used on the upper body member to reduce friction between it and the casing so that the upper body member may move downwardly to force the lower body member against the casing's interior and to enhance engagement of a toothed slip or slips on the lower body member with the casing's interior.

In other embodiments, the present invention discloses a whipstock system having: a lower inflatable packer with an orientation key; a stinger assembly with a slot for the key for co-acting with the packer to orient the system; stabilizing springs on the stinger assembly; linking apparatus for pivotably linking the stinger assembly to a lower body member; the lower body member preferably with one or more friction members such as a slip with a toothed surface; a wedge slide member movably secured partially within the lower body member and partially within an upper body member; an upper body member shear-pinned to the lower body member so that upon shearing of one or more pins, forcing the upper body member downwardly with respect to the lower body member and forcing the lower body member outwardly, the movement of the two body members constrained and guided by the wedge slide so that the lower body member moves sideways to contact an interior surface of casing in which the system is disposed while the upper body member moves to contact an opposing interior casing surface; the linking apparatus permitting pivoting of the lower body member so it moves sideways; and a whipstock concave member secured to the upper body member, preferably secured pivotably so that concave member lays back against the casing interior at a desired angle to effect a desired milling point and direction. A setting tool is secured to the concave member by a shear stud. In effect the overall largest dimension of the system at the interface of the upper and lower bodies increases as the two move with respect to each other. Thus the system is initially of a first smaller dimension so it is insertable through a relatively small diameter tubular (such as tubing) into a larger diameter tubular (e.g. casing) which extends downwardly beyond the smaller diameter tubular. Then, upon movement of the two body members with respect to each other the effective largest dimension at the body members increases and the body members, by frictional contact with the interior of a relatively larger diameter tubular (e.g. casing in which tubing is disposed), anchor the system with the larger diameter tubular for use therein. The above-described upper and lower bodies and associated interconnecting apparatus, wedge slide, or connecting bar with pawl(s), may be used to anchor any member or device in any tubular or wellbore. Also, friction members such as pads of friction materials and/or toothed slips with teeth pointed upwardly and/or toothed slips with teeth pointing downwardly may be used on both or either body members. Alternatively friction reducing members, devices, or substances may be used on the upper body member to facilitate its downward movement.

In another embodiment of a whipstock system according to the present invention which is similar to that described immediately above, there is no wedge slide member. Interconnecting apparatus such as a linking member (or members) is used to pivotably link a concave member to a lower body member so that downward force on the concave member results in the movement of both the lower body member and the concave member to contact the casing wall. The lower body member pivots with respect to the stinger assembly and moves sideways to frictionally engage one interior side of the casing while the concave member has a bottom portion that pivots with respect to the lower body member and moves sideways (away from the lower body member) to contact the opposite interior side of the casing.

In certain embodiments the present invention teaches a split lock ring for engaging a portion or shaft of a wellbore tool, including but not limited to a top cylindrical portion or stinger of a wellbore anchor apparatus. Such a lock ring in one aspect has locking or releasing interior threads which threadedly mate with exterior threads on the wellbore tool to be held. Such a lock ring in one aspect has a lower projection with an inclined surface configured and positioned to rest on and move downwardly with respect to a correspondingly inclined surface on an associated assembly so that a tool with a shaft or stinger within the lock ring, pulled down on the lock ring, forces the lock ring's inclined surface down on the inclined surface of the associated assembly, thereby increasing the force of the lock ring holding the shaft or stinger therein.

In certain embodiments the present invention discloses a survey tool assembly which includes a receptacle as previously described with a releasable lower locking assembly and: no other locking assembly therein; or a releasable additional upper locking assembly therein. The survey tool assembly also has an orientation indicator (e.g. but not limited to commercially available gyroscopic indicator assemblies) secured to the receptacle.

It is, therefore, an object of at least certain preferred embodiments of the present invention to provide:

- New, useful, unique, efficient, nonobvious whipstocks and devices for installing them in tubulars;
- Such devices for insertion through a smaller diameter tubular in a larger diameter tubular; in one aspect, for insertion through tubing into casing extending below the tubing;
- Such devices for effective anchoring of a whipstock in a tubular; and, in one aspect, a whipstock apparatus settable by pulling upwardly thereon;
- Such devices for correct orientation of a whipstock with respect to an anchor disposed in casing below tubing therein;
- New useful, unique, efficient, nonobvious anchoring devices for anchoring a member or device in a tubular or in a wellbore;
- New use, unique, efficient, and nonobvious orienting keys for anchoring devices; anchoring devices with such a key; and designs for both;
- New useful, unique, efficient, nonobvious standoff and/or support apparatus for wellbore tools, including, but not limited to, whipstock concave members;
- New, useful, unique, efficient, nonobvious split lock rings for holding a wellbore tool and designs therefor;
- New, useful, unique, efficient, nonobvious survey tool assemblies with a receptacle according to this invention, one or more releasable locking devices according to this invention within the receptacle, and an orientation indicating device secured to the receptacle;
- New useful, unique, efficient, nonobvious setting or installation tools for whipstock orientation which permit relative rotation of a whipstock system and items above the whipstock system in a tool string or tubular string and which, preferably, do not transmit torque; and
- New, useful, unique, efficient, nonobvious toggling connections for connecting two members.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention should be read to include any legally equivalent devices or methods which do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 19 G is an enlargement of a split lock ring shown in FIG. 19E. FIGS. 19D–G show an upper locking assembly according to the present invention.

FIG. 35B is a view of the side of the anchor opposite the side shown in. FIG. 35A.

DESCRIPTION OF EMBODIMENTS PREFERRED AT THE TIME OF FILING FOR THIS PATENT

Figure 1:
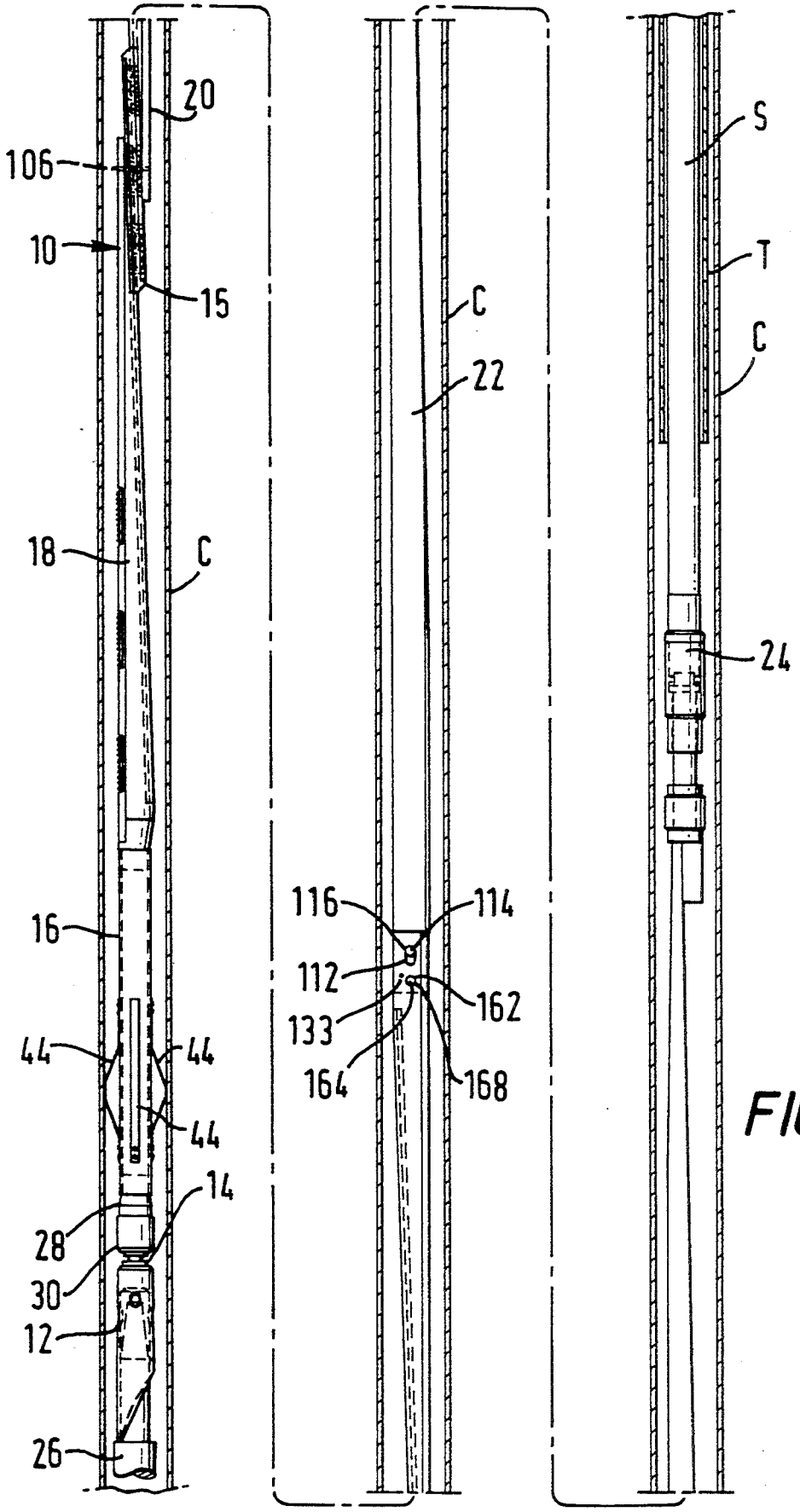
FIG. 1 is a side cross-sectional view of a whipstock system according to the present invention.
Figure 2:
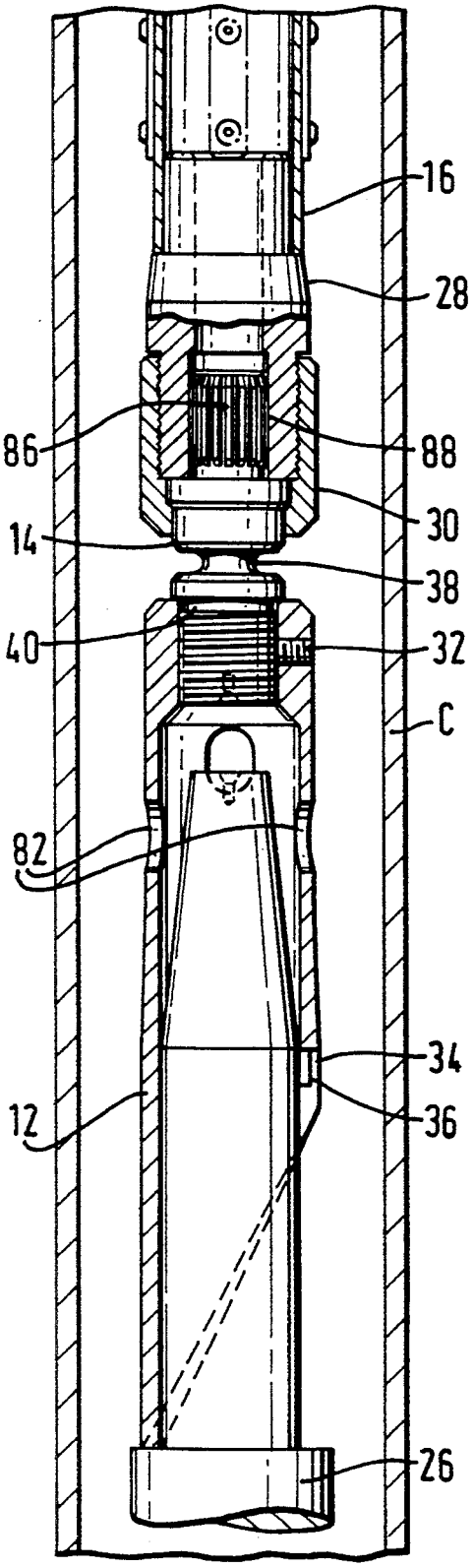
FIG. 2 is a side cross-sectional view of part of the system of FIG. 1 including a splined flexion member.
Figure 3:
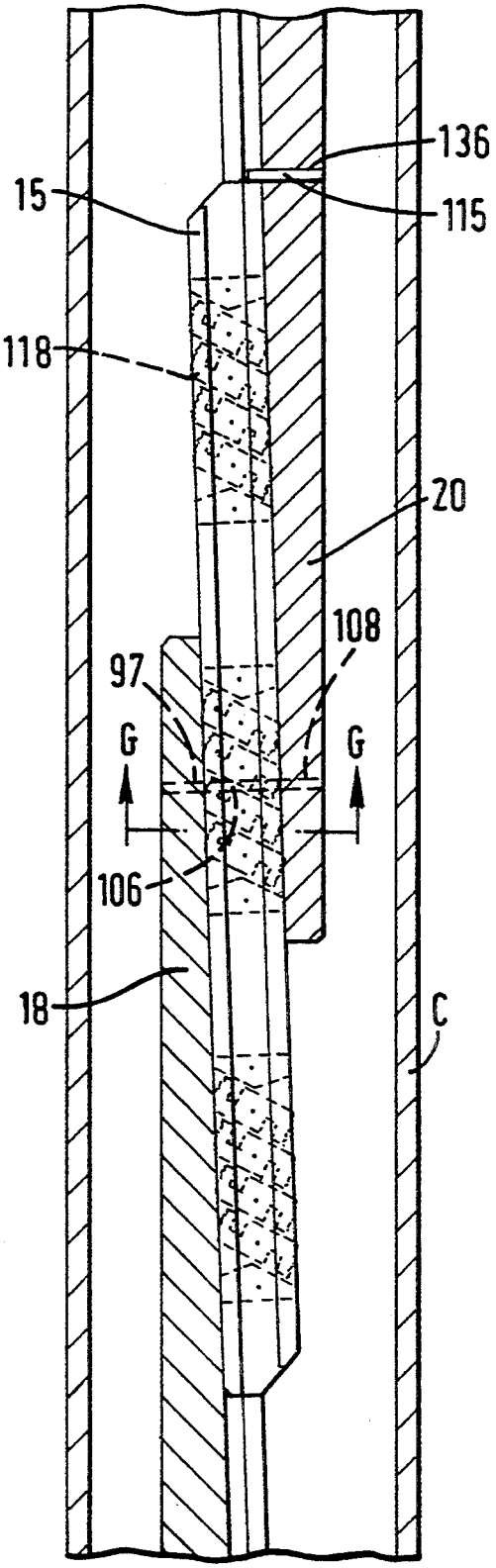
FIG. 3 is a side cross-sectional view of a connecting bar of the system of FIG. 1.

Referring now to FIG. 1, a whipstock system 10 according to the present invention has a lower receptacle 12 to which is secured a splined flexion member 14 by set screws 32. A locking nut 30 secures a top end of the splined flexion member 14 to an adapter 28. The adapter 28 is welded to a tube 16 which itself is welded to a lower end of a lower body member 18. A connecting bar 15 interconnects the lower body member 18 and an upper body member 20. A concave member 22 is secured to a top of the upper body member 20. An installation tool 24 is releasably secured to a top of the concave member 22.

As shown in FIG. 1, the system 10 has been inserted on a string S which typically includes (from the installation tool up) a crossover sub, a drill collar (for weight), a connector to the drill collar, and a length of coiled tubing which extends to the surface. The tubing T extends through casing C and the casing C extends downwardly below the tubing T. The receptacle 12 has a key slot 34 for receiving a key 36 on a lower anchor member 26 previously emplaced in the casing C, thus correctly orienting the system 10 in a desired orientation with respect to the casing C and therefore with respect to a wellbore (not shown) in which the casing is installed.

Figure 6A:
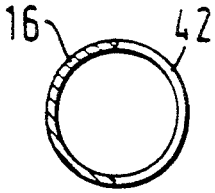
FIG. 6A is a cross-sectional view through the notch of the tube of FIG. 6B.
Figure 6B:
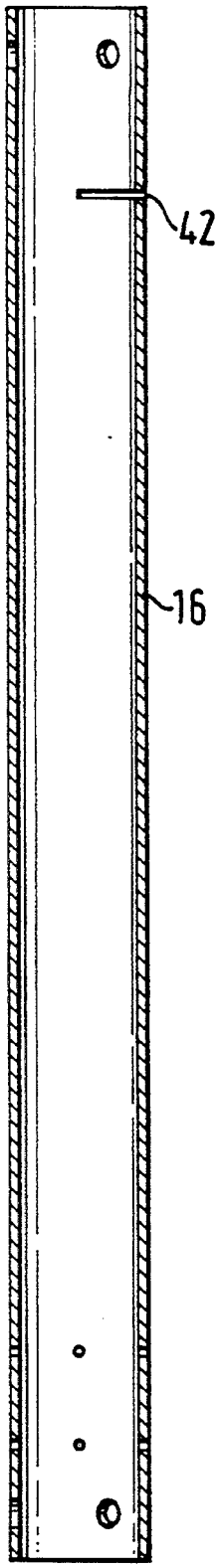
FIG. 6B is a side cross-sectional view of the tube of the system of FIG. 1.

Sideways movement of the lower body member 18 is permitted and facilitated by two items: the splined flexion member 14 and the notched tube 16 so that the lower body member will move sideways as desired up against an interior side wall of the casing C. The splined flexion member 14 has a neck 38 of reduced size as compared to the size of a body 40 of the member 14. The splined flexion member 14 (in one embodiment made from steel) flexes at the neck 38. The tube 16 has one (or more) notches 42 cut therethrough which permit the tube 16 to bend to a small degree. As shown in FIG. 6A the notch 42 occupies half of the circumference of the tube 16. Four centralizing bow springs 44 (three shown in FIG. 1) are disposed on the tube 16.

Figure 4:
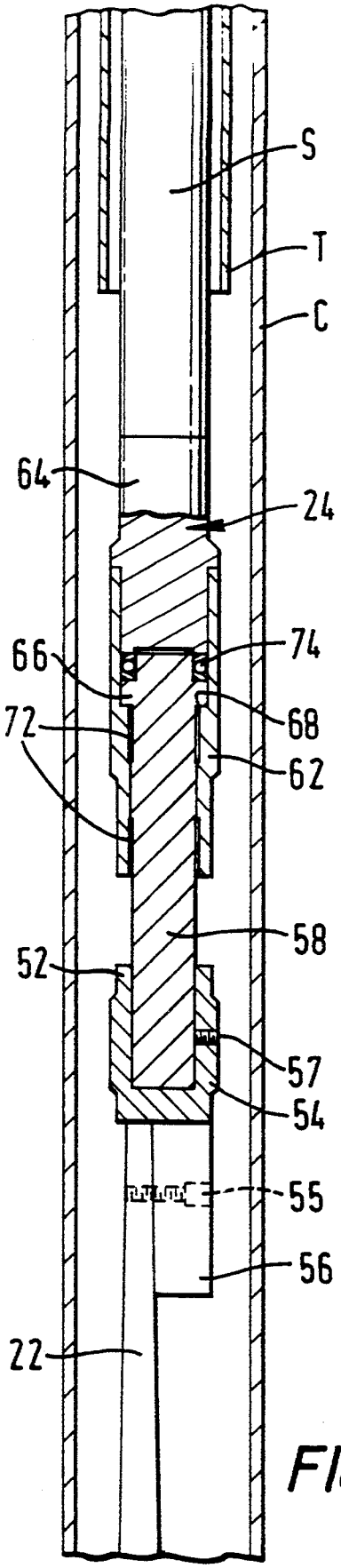
FIG. 4 is a side cross-sectional view of an installation tool of the system of FIG. 1.

FIG. 4 illustrates the installation tool 24 according to the present invention. The tool 24 has a lower adapter 52 with a sleeve 54 and a block 56° The block 56 is secured to the concave member 22 with a screw 55. A mandrel 58 is threadedly engaged within the sleeve 54 and a set screw 57 prevents rotation of the mandrel 58 in the sleeve 54. The mandrel 58 is rotatable within a housing 62. The housing 62 threadedly engages an upper sub 64. The upper sub 64 interconnects the system 10 to connectors and to connectors and to tubing extending from the surface and into the casing. The mandrel 58 has a flange 66 which abuts an interior shoulder 68 of the housing 62. Brass sleeve bearings 72 facilitate rotation of the mandrel 58. A thrust bearing 74 serves to facilitate rotation of the mandrel 58 with respect to the sub 64 when downward force is applied to the sub 64. The screw 55 does not experience a downward force when the system is being run into the hole since the bottom surface of the sleeve 54 abuts a top surface of the concave. When the screw 55 shears (after the tool is set and the system above the installation tool is to be removed) the shoulder 68 is pulled up against the flange 66 to remove the installation tool 24 from the hole.

Figure 5A:
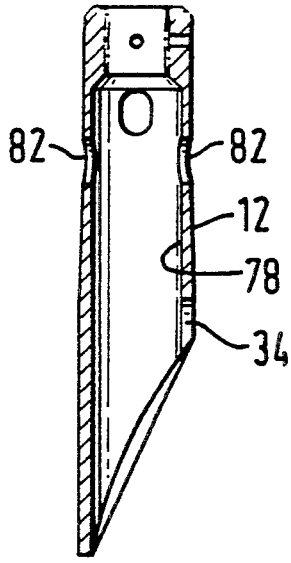
FIG. 5A is a side cross-sectional view of a receptacle of the system of FIG. 1.
Figure 5B:
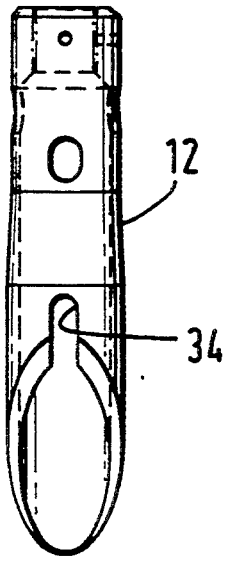
FIG. 5B is a front view of the receptacle of FIG. 5A.

FIGS. 5A and 5B show the receptacle 12. It has a key slot 34 for receiving the key 36 on 'the anchor 26. Material and debris entering a channel 78 exit through ports 82. Set screws 32 hold the receptacle 12 on a lower end of the splined flexion member 14.

Figure 7:
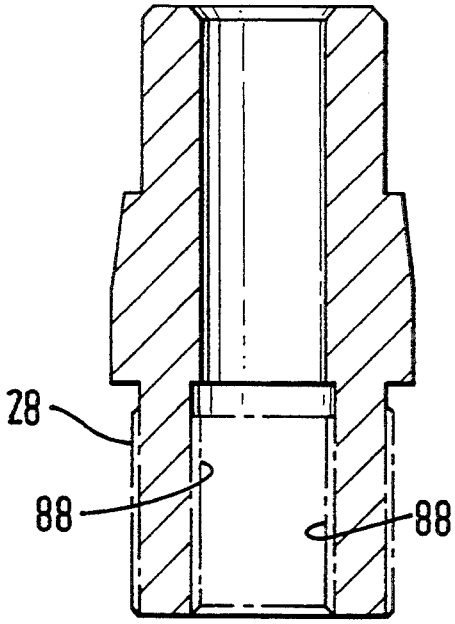
FIG. 7 is a is a side cross-sectional view of the adapter of the system of FIG. 1.
Figure 8:
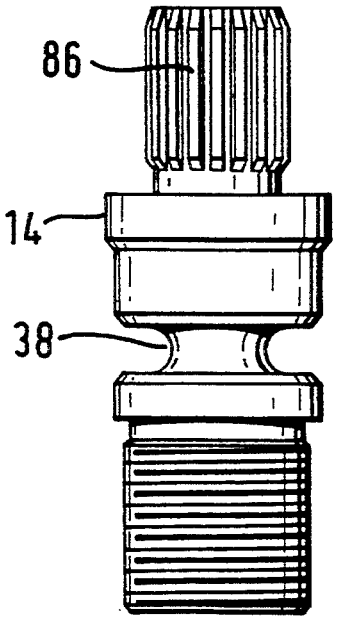
FIG. 8 is a side cross-sectional view of the splined flexion member of the system of FIG. 1.

As shown in FIGS. 7 and 8, external splines 86 on a top end of the splined flexion member 14 mate with internal spline recesses 88 in the adapter 28. The splined flexion member 14 (or alternatively the adapter 28) can be rotated to achieve a desired orientation of the receptacle 12 with respect to the adapter 28 and hence with respect to the rest of the system. When the desired position is achieved, the splined flexion member's top end is inserted into the adapter 28 and the locking nut 30 is tightened on the adapter 28. Further rotation of the receptacle 12 can be achieved by rotating the entire system 10 at the mandrel 58—housing 62 interface of the installation tool 24. This can be done above the surface prior to insertion of the system 10 into a tubular or wellbore.

Figure 10A:
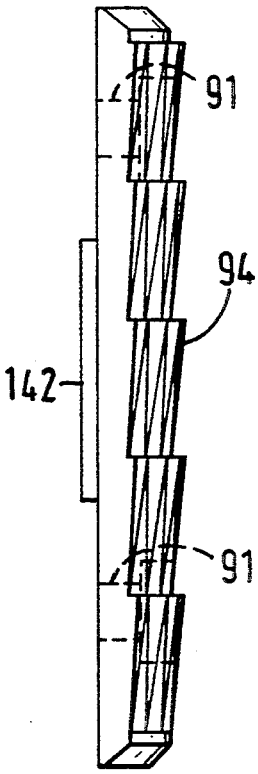
FIG. 10A is a perspective view of a friction member of the system of FIG. 1.
Figure 10B:
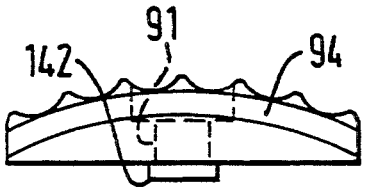
FIG. 10B is a top view of the friction member of FIG. 10A.
Figure 11A:
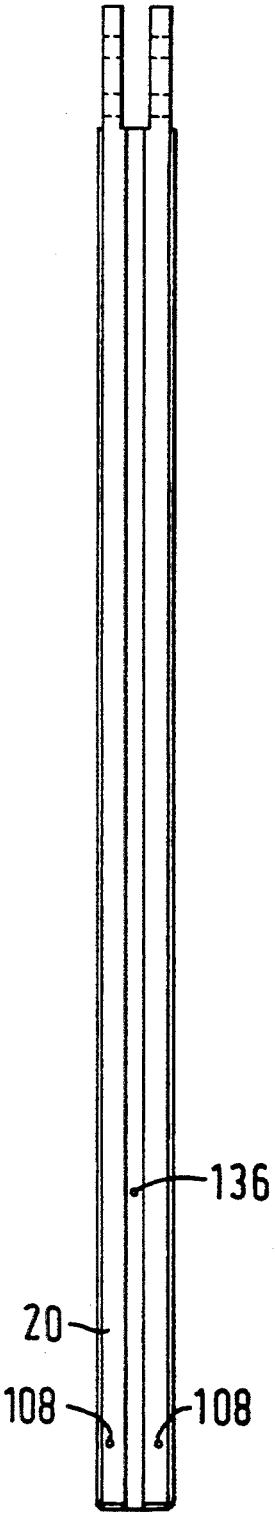
FIG. 11A is a side view of an upper body member of the system of FIG. 1.
Figure 11B:
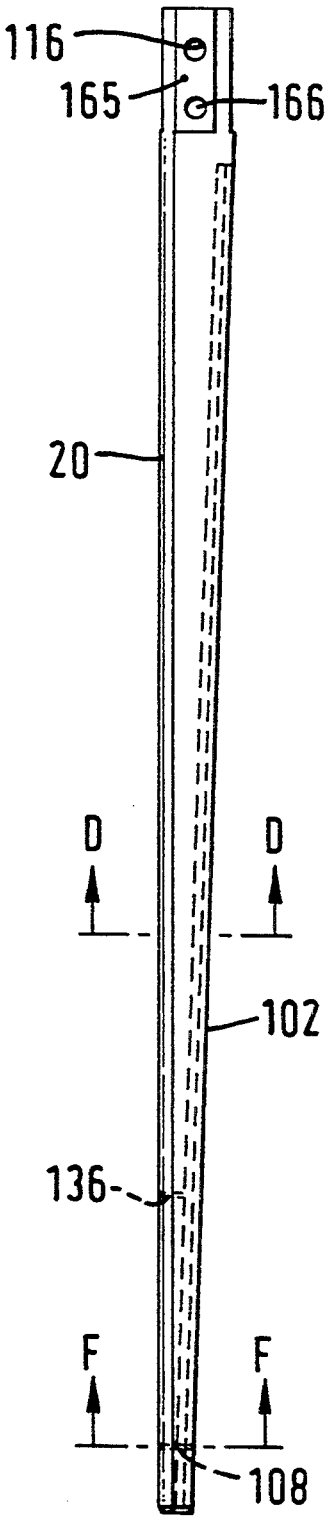
FIG. 11B is another side view of the upper body member of FIG. 11A.
Figure 11C:
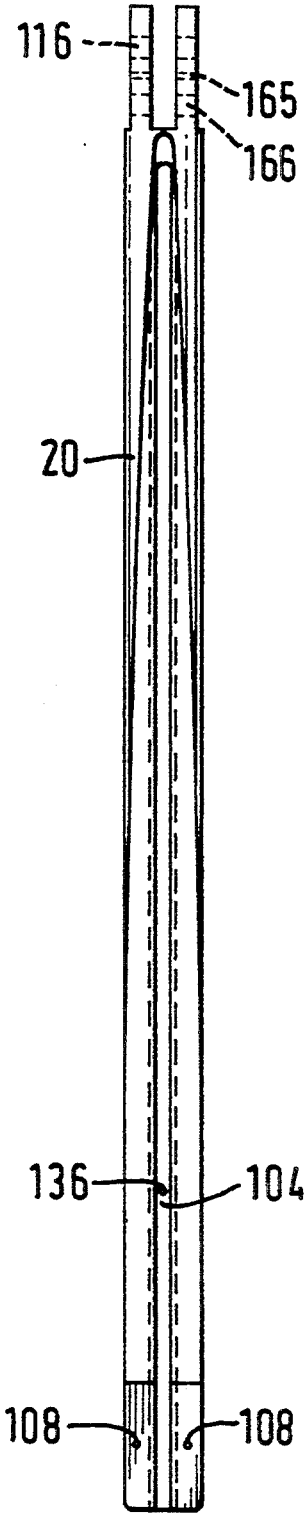
FIG. 11C is another side view of the upper body member of FIG. 11A.
Figure 11D:
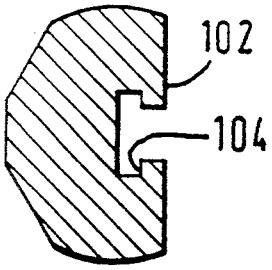
FIG. 11D is a cross-sectional view along line D—D of FIG. 11B.
Figure 11E:
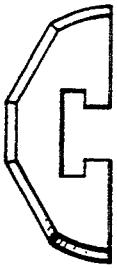
FIG. 11E is a bottom end view of the upper body member of FIG. 11B.
Figure 11F:
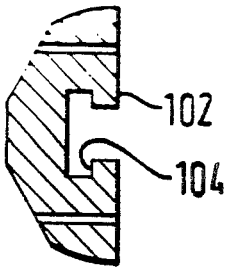
FIG. 11F is a cross-sectional view along line F—F of FIG. 11B.
Figure 12D:
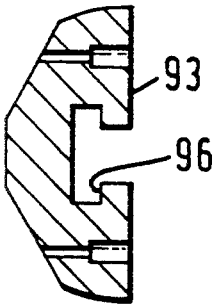
FIG. 12D is a cross-sectional view along line A—A of FIG. 12B.
Figure 12E:
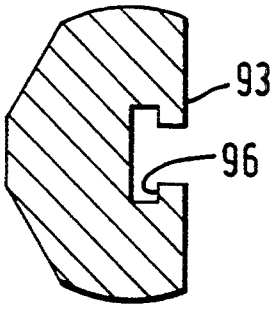
FIG. 12E is a cross-sectional view along line B—B of FIG. 12B.
Figure 12F:
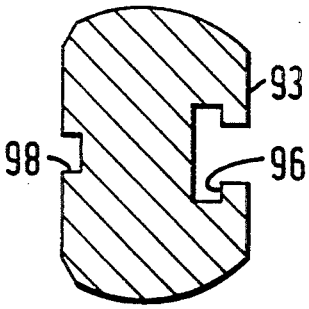
FIG. 12F is a cross-sectional view along line C—C of FIG. 12B.

The lower body member 18, shown in FIGS. 1 and 12A–12F, has one or more recesses 92 in which are mounted friction members 94 (see FIG. 10A). As shown, the lower body member 18 tapers from top to bottom having a taper surface 93 and a T-shaped groove 96 along its length which holds the connecting bar 15 and guides the movement of the connecting bar 15. A slot 98 in each recess 92 facilitates emplacement of rear ribs 142 of the friction members 94; and screws 99, extending through holes 91 in the friction members 94 and into holes 95 in the lower body member 18, hold the friction members 94 in place. Holes 97 at the top of the lower body member 18 receive shear members for interconnecting the connecting bar 15 and the upper body member 20.

The upper body member 20, shown in FIGS. 1 and FIGS. 11A–11F, tapers from bottom to top and has a taper surface 102 corresponding to the taper surface 93 of the lower body member 18. Thus as the upper body member moves downwardly with respect to the lower body member, the effective largest dimension of the combined body members and connecting bar increases. A groove 104 extends along the length of the upper body member 20 in which is held and in which moves a portion of the connecting bar 15. Shear pins 106 extend through holes 108 in the lower part of the upper body member 20, through the connecting bar 15 and into the holes 97 in the upper part of the lower body member 18. The concave member 22 is pinned to the upper body member 20 with a connecting pin 112 that extends through holes in the concave member 22 and holes in the upper body member 20.

Figure 9A:
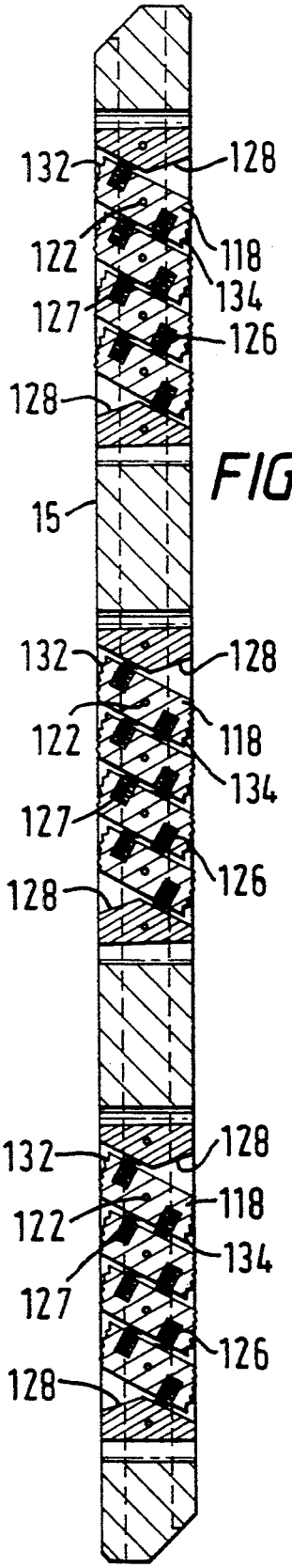
FIG. 9A is a side view of a connecting bar of the system of FIG. 1.
Figure 9B:
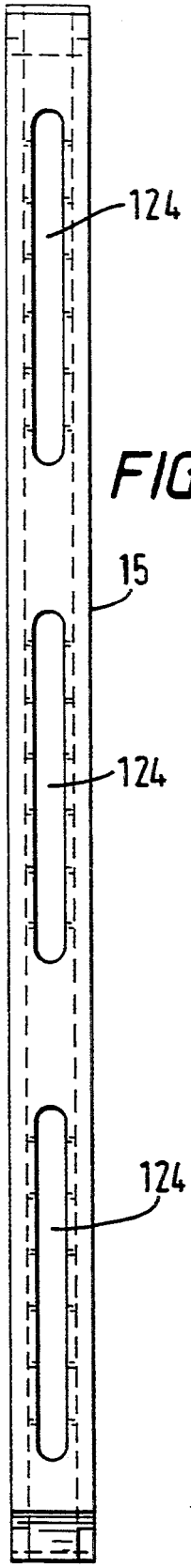
FIG. 9B is another side view of the connecting bar of FIG. 9A.
Figure 9C:
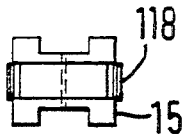
FIG. 9C is a cross-sectional view of the bar of FIG. 9A.

FIGS. 1, and 9A–9C show the connecting bar 15. In certain preferred embodiments, the bar has one or more movable pawls 118 pinioned with a center pin 122 within slots 124 in the bar 15. Springs 126 are partially disposed in spring recesses 127 in the pawls 118. Each spring is biased against an adjacent pawl or an adjacent edge 128 to insure that all the pawls in a series of pawls remain in contact and move together. Edges 128 of each slot 124 acts as a panel stop to prevent further counterclockwise (as viewed in FIG. 9A) rotation of the pawls 118. While the system 10 is run into the casing C, the upper and lower body members are pinned together with the connecting bar 15 pinned between them by the pin 106. The pin 106 extends through hole 108 in the upper body member 20 and hole 97 in the lower body member 18. When the pin 106 holding the upper and lower body members are sheared and relative movement is permitted between the upper and lower body members, the connecting bar 15 guides and controls this movement. As the movement commences, the pawls 118 rest in the slots 124. However, if an upward force is applied to the system 10, pulling the upper body member 20 upwardly, the pawl(s) 118 pivot so that toothed surfaces 132 on one side of some of the pawls engage the lower body member 18 and toothed surfaces 134 on the other side of some of the pawls engage the upper body member (some of the pawls in the middle engaging both body members) thereby preventing upward movement of the upper body member 20 with respect to the lower body member 18. Movement of the middle pawls contacting both body members also forces the two body members apart. This renders the system 10 effectively anchored in the casing C with the lower body member 18 and the upper body member 20 in contact with the casing's interior surface. As shown in FIG. 9C, ends of the pawls 118 will protrude slightly from the bar 15 upon rotation of the pawls in response to an upward force so that the pawls' toothed surfaces can engage the upper and/or lower body members.

Figure 13A:
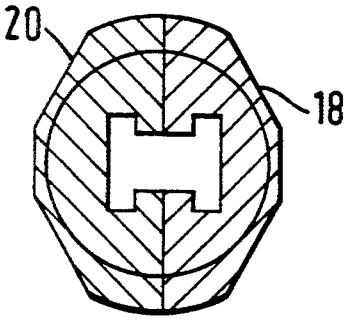
FIG. 13A is a cross-sectional view along line G—G of FIG. 3 with the connecting bar omitted.
Figure 13B:
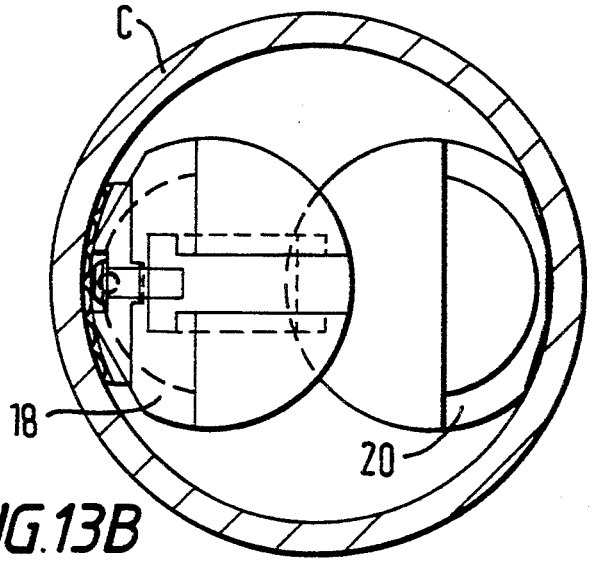
FIG. 13B is a cross-sectional view of the tool of FIG. 3 with upper and lower body members in contact with a casing's interior.
Figure 12A:
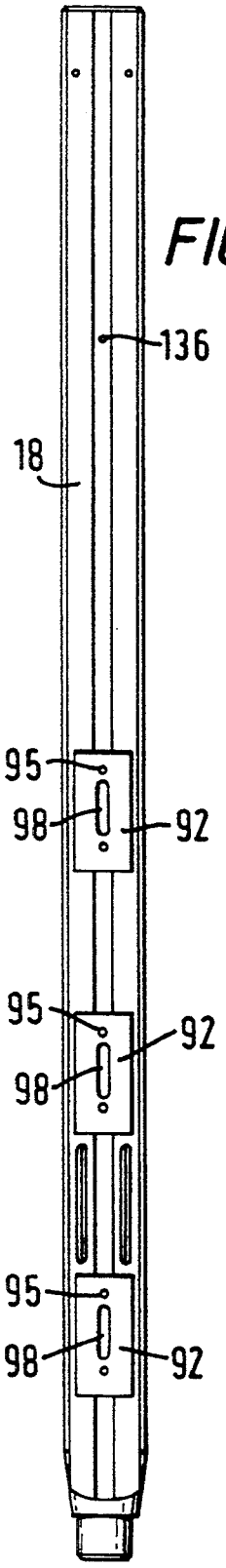
FIG. 12A is a side view of a lower body member of the system of FIG. 1.
Figure 12B:
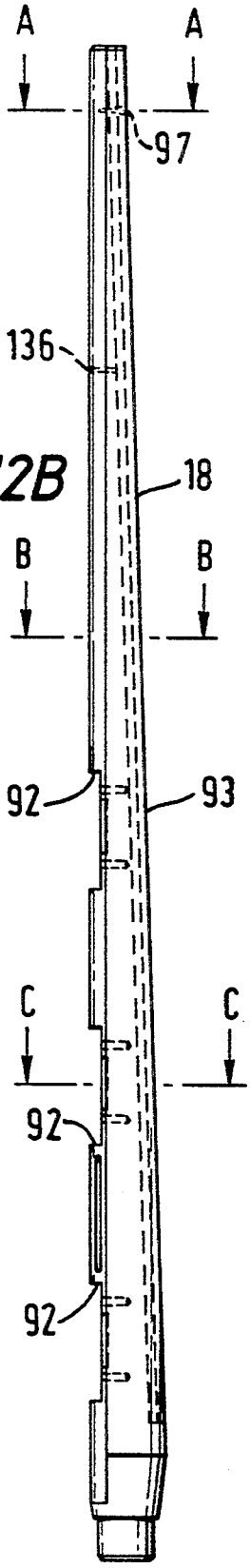
FIG. 12B is another side view of the member of FIG. 12A.
Figure 12C:
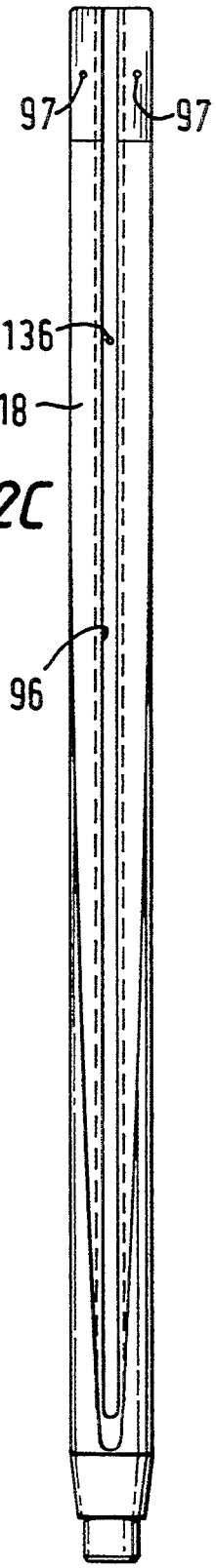
FIG. 12C is another side view of the member of FIG. 12A.

In one operation according to this invention, a system 10 according to the present invention is inserted into and through tubing which has been run into casing in a wellbore. The system 10 is at the end of a string as previously described and descends through the tubing, exiting the tubing and entering casing within the wellbore. The system is lowered to a desired point in the casing until the receptacle 12 encounters the anchor 26 and the system 10 is oriented correctly with respect to the anchor's key. Then pushing down on the system 10 shears the pin 106 (e.g. at 2000 pounds force) freeing the upper and lower body members for relative movement. As the upper body member 20 moves downwardly with respect to the lower body member 18, the pin 115 partially disposed in a hole 136, has a protruding portion which moves into contact with a top of the connecting bar 15. The upper body member moving downwardly thus begins to force the connecting bar 15 downwardly. Once the bar 15 reaches a lower limit of its downward travel (at the end of the groove in which the bar moves or due to contact between the upper body member and the casing's interior), further force (e.g. about 500 pounds) on the upper body member 20 shears the pin 115 permitting the upper body member 20 to move further downwardly. As this is occurring, the lower body member 18 is forced sideways in the casing and eventually into frictional contact with the casing's interior (see FIG. 13B). Toothed slips on the lower body member are forced into engagement with the casing's interior with teeth oriented to inhibit upward movement of the lower body member. During movement of the upper body member, the parts of the assembly below the lower body member pivot at the neck of the splined flexion member 14 and at the notch 42 of the tube 16 so that the lower body member 18 pivots to move sideways against the casing's interior. Once the two body members are wedged into place across the casing (see FIG. 13B) (i.e., the system 10 is stabilized so it does not move up or down in the casing or rotate therein), the installation tool 24 is freed from the system 10 by pulling up on the tool 24 with sufficient force to shear the screw 55 (e.g. 12,000 to 15,000 pounds force). Upon removal of the tool 24 and the string to which it is attached, a milling tool may be inserted into the wellbore through the tubing and casing to contact the concave member 22 of the system 10 for a milling operation.

Figure 16:
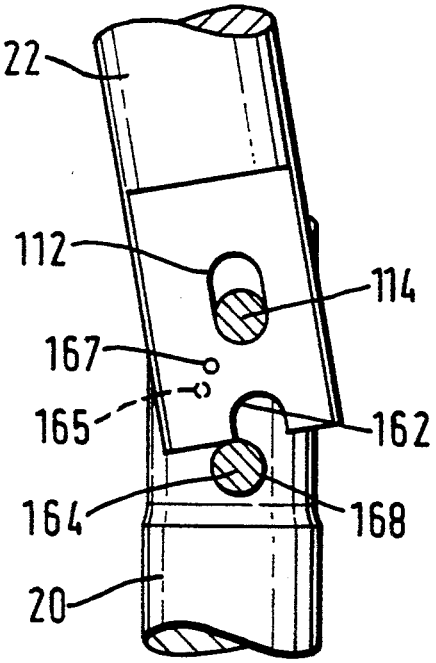
FIG. 16 is a partial side view of a toggling connection according to the present invention.

The concave member 22, as shown in FIG. 16, due to the configuration of the hole 112, is free to move upwardly (e.g. about one-half inch in certain embodiments) A toggling connection according to the present invention connects the concave member 22 and the upper body member 20. Initially it is restrained from such movement by a shear pin 133. When an upward pulling force is applied to the system 10 after the upper and lower body members have moved outwardly to wedge against the casing, the shear pin 133 (FIG. 1) is sheared (e.g. at 8,000 pounds force) freeing the concave member 22 to move and to pivot with respect to the upper body member 20. The shear pin 133 extends from a pin hole 165 in the upper body member 20 into a pin hole 167 in the concave member 22. The concave member 22 pivots on the pin 114 which extends through the hole 116 in the upper body member 20 and the hole 112 in the concave member 22. The holes 116 and 112, and 162 and 164, are configured and positioned to allow the concave member 22 to move and to pivot. As shown in FIG. 16, the upper hole 112 of the concave member 22 is elongated providing room for the pin 114 to move therein and the lower half hole 162 which initially encompasses the pin 164 is movable away from the pin 164.

FIGS. 14A–14D illustrate a whipstock system 200 according the present invention which has an inflatable anchor packer 201 with an orientation key 202; a stinger assembly 203 for co-acting with the orientation key 202 to orient the system 200; a tube 221 to interconnect the stinger assembly 203 and an interconnecting link apparatus 205 (one or more connecting links); stabilizing spring bows 204 for centering the tube 221 in a casing C; the link apparatus 205 pivotably linking together the tube 221 and a lower body member 206; the lower body member 206 movably secured to an upper body member 207 by a wedge slide 208; the wedge slide 208 having a T-member 209 movably disposed in a groove 211 in and along the top side of the lower body member 206 and a T-member 210 movably disposed in a groove 212 in and along the top side of the upper body member 207; a concave member 213 hingedly connected to the upper body member 207 with a pin 214; and a setting tool 215 secured to the concave with a shear stud 216. A shear pin 217 secures the upper body member 207 to the wedge slide 208 and a shear pin 218 secures the lower body member to the wedge slide 208.

Figure 14A:
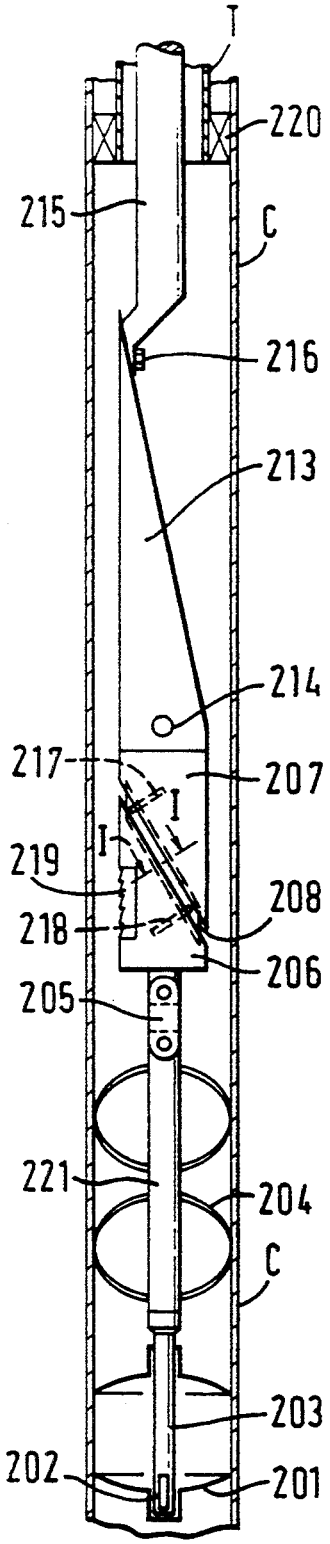
FIGS. 14A–14C is a side schematic views of a system according to the present invention.
Figure 14B:
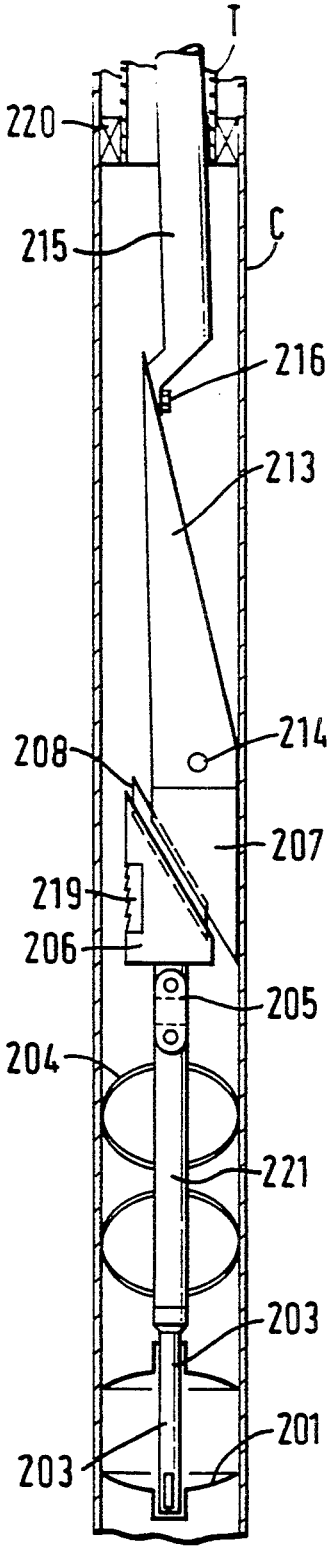
Figure 14C:
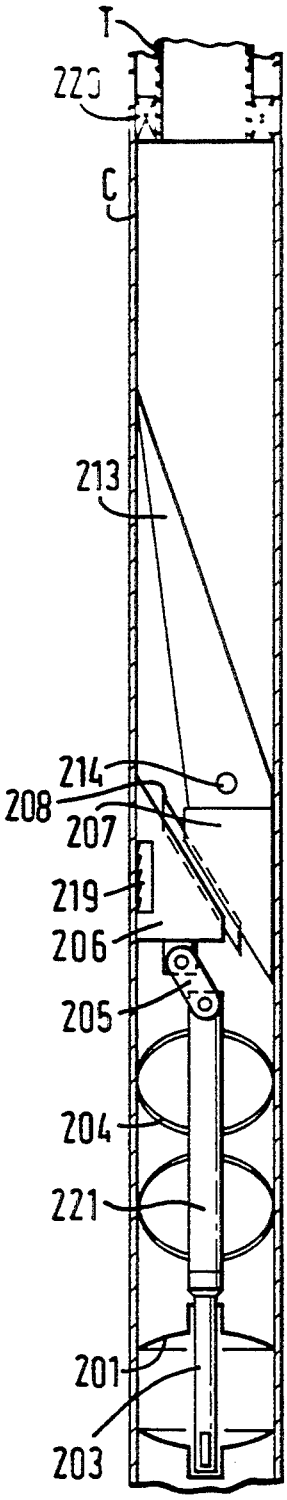
Figure 14D:
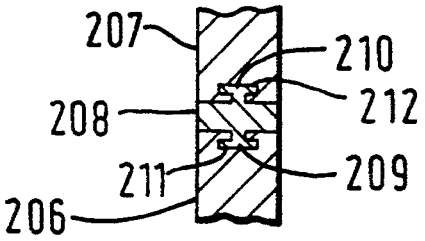
FIG. 14D is a cross-sectional view along line H—H of FIG. 14A.

As shown in FIG. 14A, the system 200 has been inserted through a casing S which has a smaller diameter than the casing C. The shear pins 217 and 218 have not been sheared so the upper and lower body members 207, 206 have not moved with respect to each other. As shown in FIG. 14B, downward force has been applied through the setting tool 215 shearing the shear pins 217, 218 and moving the upper body member downwardly and sideways to contact the interior of the casing C. Further downward force on the setting tool 215 has pushed the lower body member against the casing's interior (FIG. 14C) and a toothed slip 219 has engaged the casing's interior. Also, the force on the shear stud 216 has been sufficient to shear it and free the setting tool 215 which, as shown in FIG. 14C, has been removed. The lower body member 206 has pivoted on the link apparatus 205 and moved to engage the casing. The concave member 213 has pivoted at the hinge pin 214 to fall back against the casing's interior. An appropriate mill or other tool can now be inserted into the casing to engage the concave member 213. A packer 220 isolates the two casings.

Figure 15:
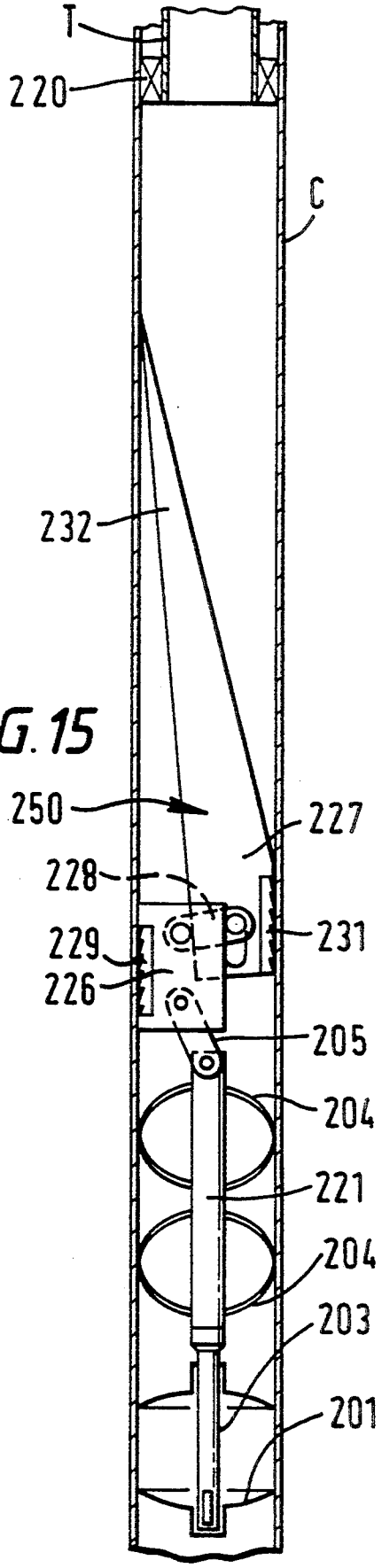
FIG. 15 is a side schematic view of a system according to the present invention.
Figure 17:
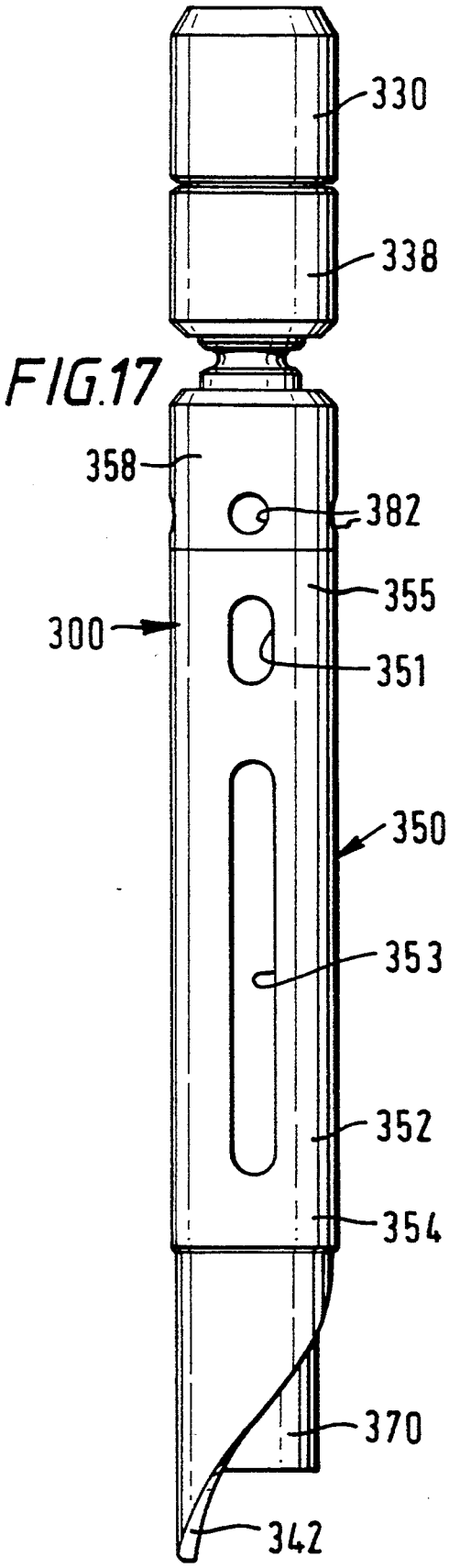
FIG. 17 is a side view of a receptacle according to the present invention.
Figure 18:
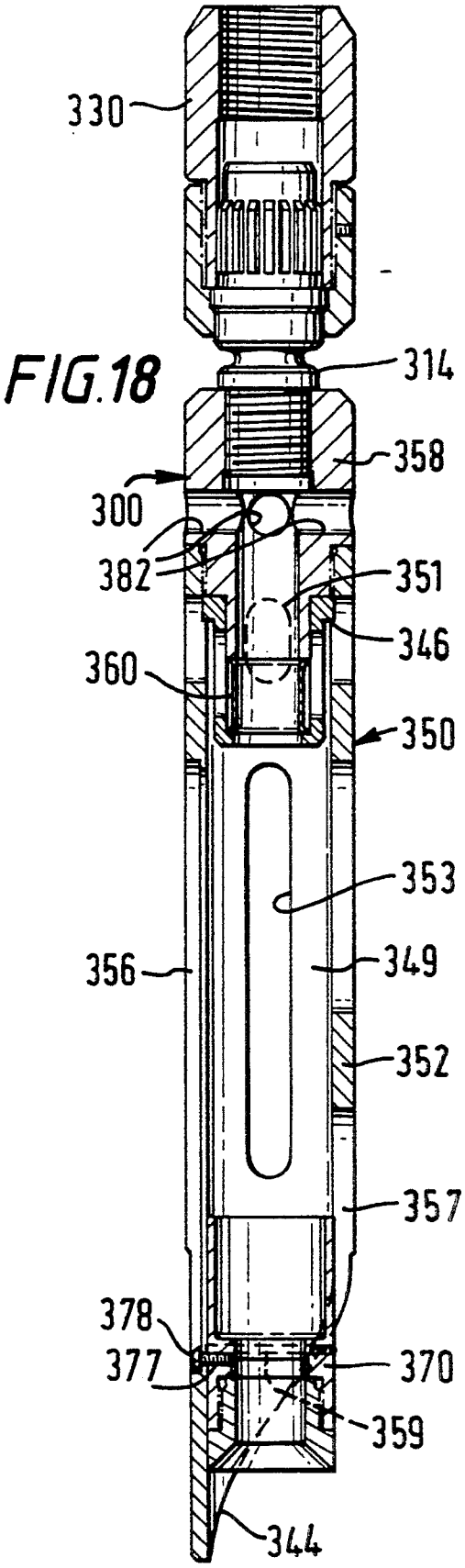
FIG. 18 is a cross-sectional view of the receptacle of FIG. 17.
Figure 19A:
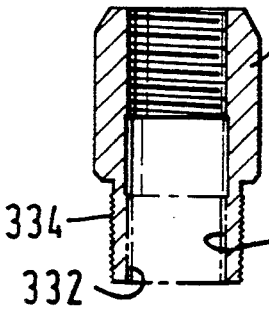
FIGS. 19A–19G are side cross-sectional views of pieces of the receptacle of FIG. 17.
Figure 19B:
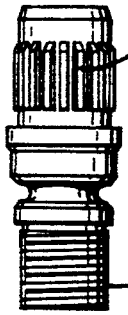
Figure 19C:
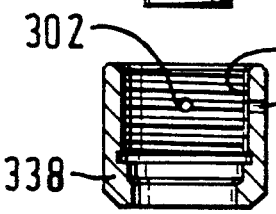
Figure 19D:
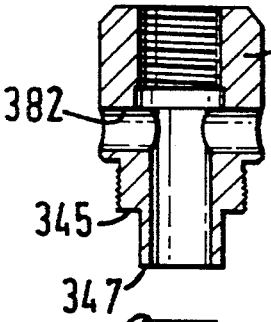
Figure 19E:
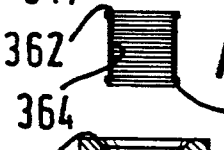
Figure 19F:
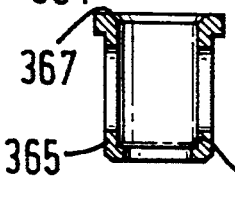
Figure 19G:
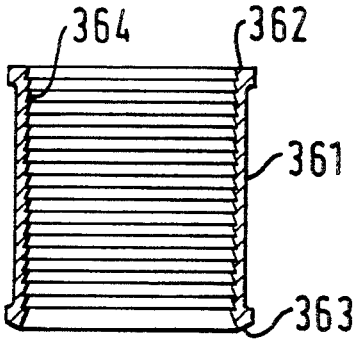
Figure 26:
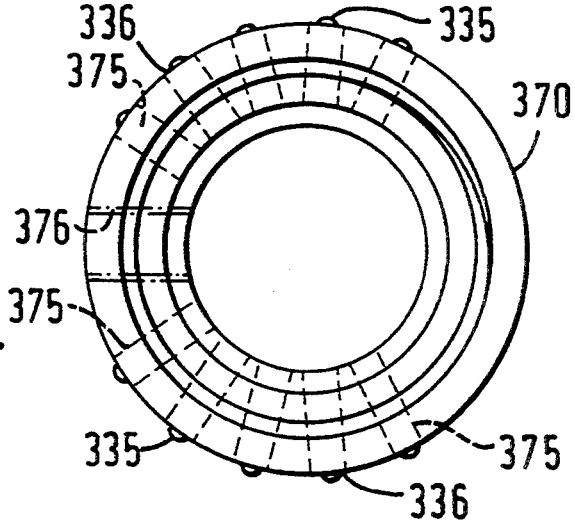
FIG. 26 is a partial cross-sectional view of the assembly of FIG. 25 through a ring of detents therein.

FIG. 15 illustrates a system 250 according to the present invention which is similar to that of FIG. 14 and similar parts have similar numeral indicators. The link apparatus 205 (one or more connecting links) interconnects the tube 221 with a lower body member 226 having a toothed slip 229. An upper body member 227 with a toothed friction member 231 is pivotably connected to the lower body member 226 by link apparatus 228 (one or more connecting links; plural links disposed opposite each other) and a concave member 232 is formed integrally of the upper body member 227. The system 250 may include the other items shown in FIG. 14A and operates in a similar manner with the link apparatus 228 serving to control and guide upper and lower body member movement.

FIGS. 17–28 show an orientation assembly 300 according to the present invention which has a locking nut 330 (like the locking nut 30) and a splined flexion member 314 (like the splined flexion member 14). The locking nut 330 has internal female splines 332 into which move and are positioned male splines 316 of the splined flexion member 314. Lower outer threads 334 on the locking nut 330 threadedly engage inner threads 336 on a lower nut 338 to secure the splined flexion member 314 to the locking nut 330. One or more set screws (not shown) extend through holes 302 in the lower nut 338 to secure it to the locking nut 330.

A receptacle assembly 350 according to the present invention includes a receptacle nut 358; a receptacle 352; an upper locking assembly 360; and a lower alignment assembly 370.

The receptacle 352 has an upper fluid exit hole 351 and two side fluid exit holes 353 through which fluid in the receptacle 352 may exit as another member (e.g. part of a wellbore anchor) enters a lower end 354 of the receptacle 352 and pushes fluid out as it moves from the lower end 354 toward an upper end 355 of the receptacle 352. A hole 382 (like the ports 82) permits fluid to exit from the receptacle nut 358. A screw slot 356 accommodates a screw as described below and a key slot 357 accommodates an anchor guide key as described below. A groove 359 receives one or more detent members as described below. The receptacle 352 has dual opposed guide surfaces 342 and 344 on a nose 340.

The lower alignment assembly 370 (see FIG. 22) is releasably and movably positioned in a central longitudinal channel 349 of the receptacle 352. The lower alignment assembly: facilitates entry of another member, e.g. a stinger of a wellbore anchor, into the receptacle 352; facilitates proper alignment of the stinger (or other member) with respect to the receptacle, thereby facilitating proper alignment of a tool, device or apparatus connected to the orientation assembly 300; facilitates movement of the stinger (or other member) and a portion of the anchor (or other member) within the receptacle 352; and enhances stability of the anchor (or other member) within the receptacle 352 both during movement and at a point at which the stinger, anchor, or other member has moved to contact the upper locking assembly 360 (or some other upper part of the receptacle 352 in embodiments not employing an upper locking assembly 360).

The lower alignment assembly 370 (see FIGS. 22–28) has a body 371 with an upper hollow cylindrical portion 372 having an internal shoulder 373; one or more holes 374 through which detents 375 extend; a hole 376 in which a portion of a screw 377 is threadedly engaged, the screw 377 having a screwhead 378; an initial locking split ring 379 with two-way threads 381 (see FIG. 28); with a top 382 that abuts an inner shoulder 383 of the body 371; and a lower guide 384 with exterior threads 385 which engage interior threads 386 of the body 371 and a shoulder 387 that abuts a lower shoulder 388 of the body 371; the guide 384 having an inwardly tapered lip 389 to facilitate reception of another member in the lower alignment assembly 370.

Figure 27:
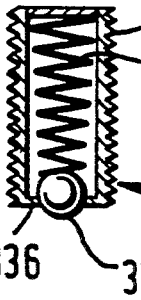
FIG. 27 is a side cross-sectional view of one of the detents of the assembly of FIG. 26.

FIG. 27 shows a detent 375 with a body 331 and a spring 333 therein which urges a detent ball 335 exteriorly of the body 331 through a hole 336 (which is not large enough for the ball to escape). In one embodiment ten detents (e.g. see FIG. 26) are used and the force of the springs of all them must be overcome to free the lower alignment assembly for movement with respect to the receptacle. Preferably the balls project into a groove from which they can be forced out with sufficient force. In one embodiment the balls are one eighth of an inch in diameter and the groove is rectangular with a depth (each side's extend) of 0.050 inches and a width (bottom extent between sides) of 0.19 inches. In one embodiment with ten detents the force applied by each is about 120 pounds and the total force to be overcome is about 1200 pounds to free the lower alignment assembly for movement. In certain preferred embodiments this force is between about a total of 500 pounds to about 1500 pounds. In one embodiment the upper hollow cylindrical portion 372 of the body 371 is about four inches; and for other embodiments is, preferably, between about two and about twelve inches long.

Figure 28:
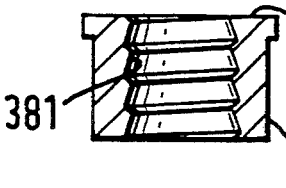
FIG. 28 is an enlargement of the lock ring of FIG. 23 showing two-way locking/releasing threads on an interior thereof.
Figure 20:
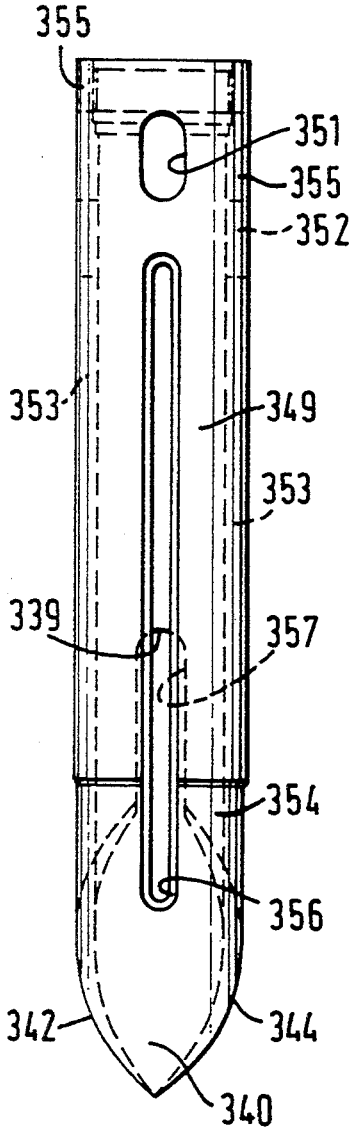
FIG. 20 is a front view of a portion of the receptacle of FIG. 17.
Figure 21:
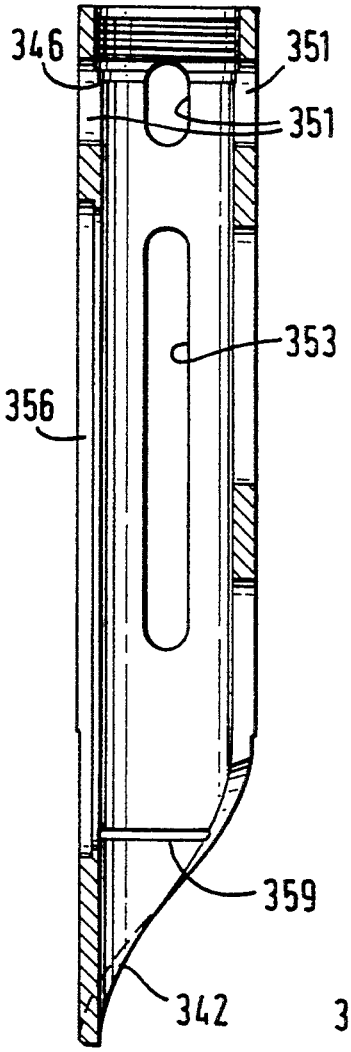
FIG. 21 is a side cross-sectional view of a receptacle body of the receptacle of FIG. 17.
Figure 22:
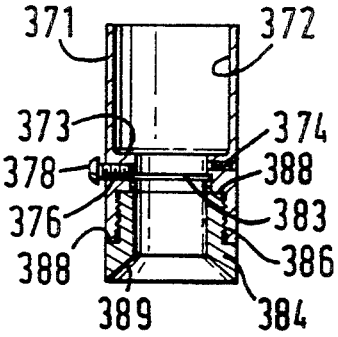
FIG. 22 is a side cross-sectional view of a lower locking assembly according to the present invention and as used in the receptacle of FIG. 17.
Figure 23:
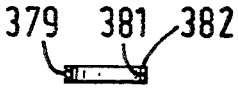
FIG. 23 is a side cross-sectional view of a lock ring of the assembly of FIG. 22.
Figure 24:
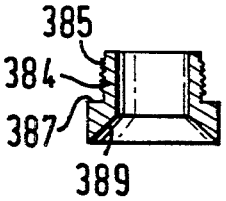
FIG. 24 is a side cross-sectional view of a lower guide of the assembly of FIG. 22.
Figure 25:
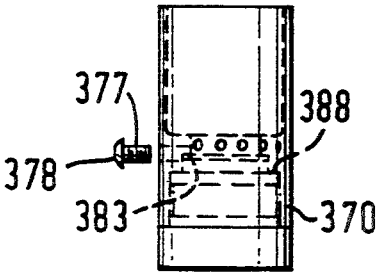
FIG. 25 is a side view, partially in cross-section, of the assembly of FIG. 22.

FIG. 28 is an enlarged view of the initial locking split ring 379 and shows the two-way threads 381.

The upper locking assembly 360 has a split locking ring 361 (see FIGS. 19E, 19G) with a top 362, a bottom 363, and interior locking one-way threads 364. The split locking ring 361 is held in place by a housing 365 so that the top 362 of the split locking ring 361 abuts an end 347 of the receptacle nut 358 and a lower shoulder 366 of the housing 365. The threads 364 are positioned to contact a member inserted into the split locking ring 361. In embodiments in which the inserted member has exterior threads or other protrusions, the threads 364 are configured and positioned to co-act with the threads or other protrusions to lock the inserted member in the upper locking assembly. In certain embodiments in which non-releasable locking of the upper locking assembly is desired, threads 364 may be two way releasing threads; they may be eliminated; or they may be configured to lock with a certain force that may be overcome by pulling up on the receptacle 352. The housing 365 has an upper shoulder 367 which is secured against a shoulder 346 of the receptacle 352 and against a shoulder 345 of the receptacle nut 358.

In certain preferred embodiments the housing 365 and the receptacle nut 358 are configured, shaped and sized so the split lock ring is movable up and down with respect thereto some small distance, e.g. in one embodiment to a total extent of about one eighth of an inch. Such movement makes it possible for the split lock ring 361, once it has engaged a portion of another wellbore tool, to be forced downwardly due to upward force on the tool containing the split lock ring and/or due to the weight of the engaged tool pulling down on the split lock ring. Such movement increases the force of the lock ring against the engaged tool due to the co-action of an inclined surface 305 on the ring 361 moving downwardly and against a corresponding inclined surface 307 on the lower shoulder 366. Thus enhanced locking force is achieved.

Figure 29:
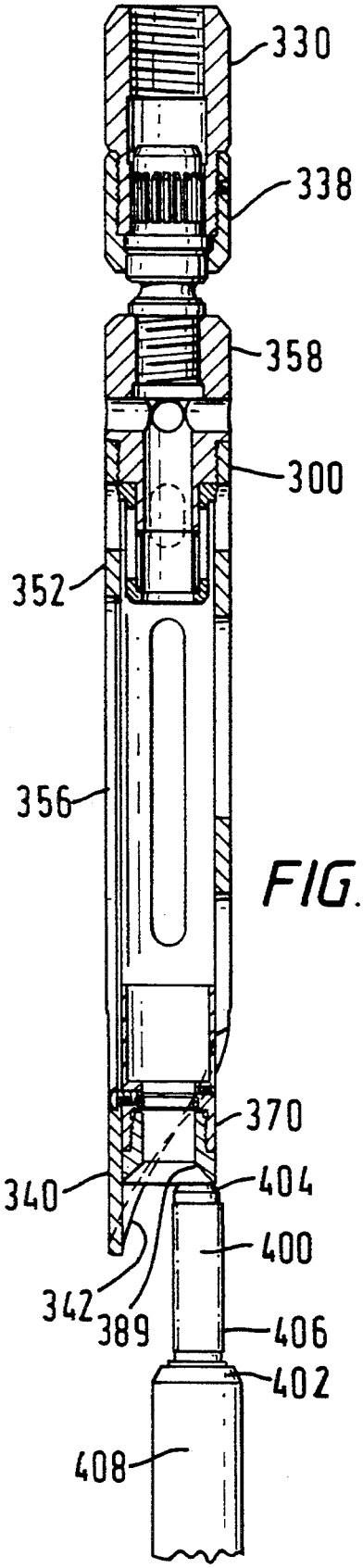
FIGS. 29–34 are side cross-sectional view showing one method of operation of tools according to the present invention.
Figure 30:
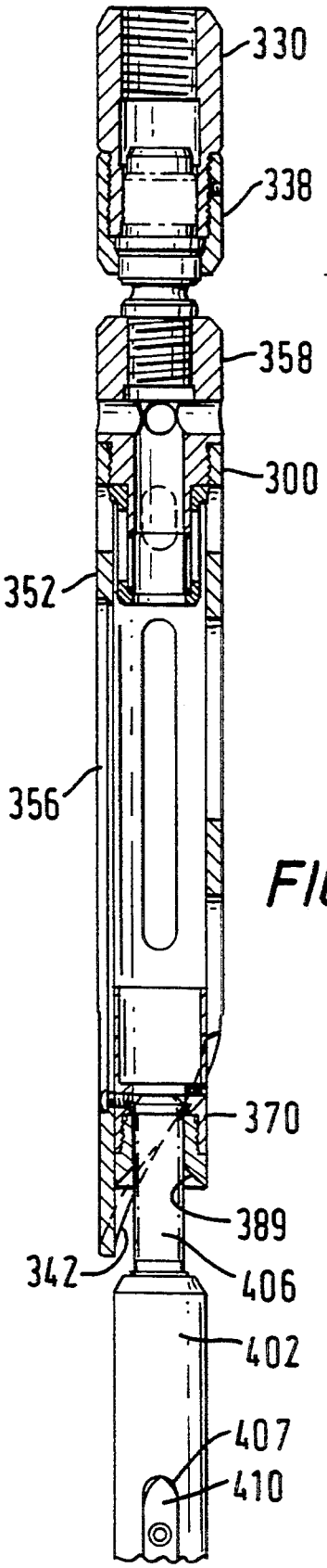

FIGS. 29–34 show one method of operation of one embodiment (300) of the present invention. As shown in FIG. 29 a stinger 400 of a wellbore anchor 402 has a tip 404 which has moved to contact the lip 389 of the lower alignment assembly 370 of the receptacle 352 of the orientation assembly 300. As shown in FIG. 30, the stinger 400 has moved further into the lower alignment assembly 370 and a portion of the stinger 400 is aligned with the receptacle 352 (central longitudinal axes of each are aligned).

Figure 31:
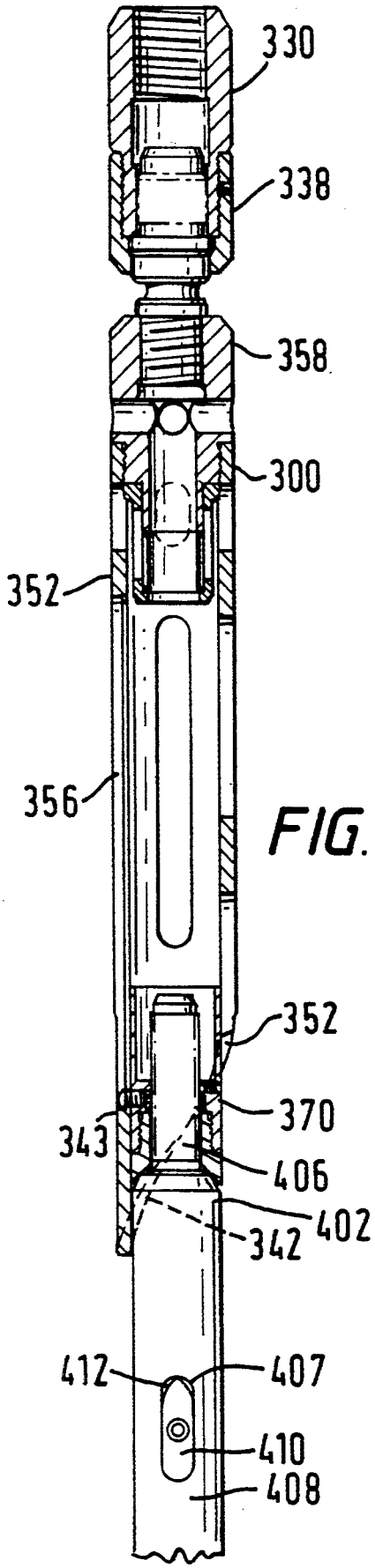

FIG. 31 illustrates further movement of the lower alignment assembly 370 in the receptacle 352 with respect to the stinger 400. Threads 381 of the initial locking split ring 379 have releasably engaged threads 406 on the exterior of the stinger 400 and the stinger 400 has rotated upwardly within the locking split ring's threads. A guide key 410 according to the present invention secured in a recess 407 of the body 408 of the anchor 402 has not yet engaged either surface 342, 344 of the nose 340 of the receptacle 352.

Figure 32:
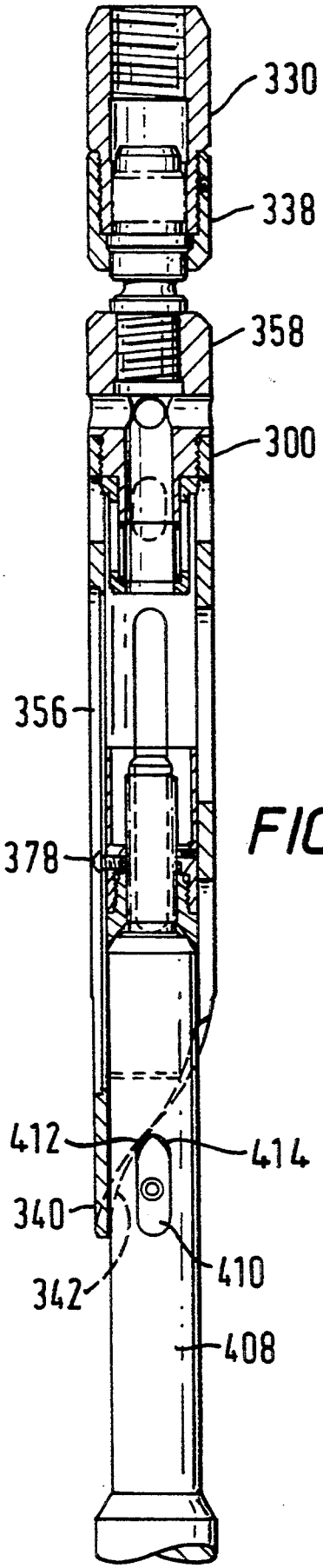

FIG. 32 shows the guide key 410 contacting a curved surface 342 of the nose 340. A surface 412 of the guide key 410 has been contacted by the surface 342 of the receptacle 352 and the receptacle 352, urged by the stationary key, has moved along the surface 412 of the key 410 and commenced to correctly orient itself with respect to the anchor 402. The force of the orientation assembly against the anchor 402 has overcome the combined spring forces of springs of the detents 375, releasing them from the groove 359 of the receptacle 352, thereby releasing the lower alignment assembly 370 for movement with respect to the receptacle 352 and permitting the receptacle 352 to move down over the anchor 402. The screw 377 with its head 378 moves in the slot 356, stabilizing and limiting the movement of the lower alignment assembly. Initially screw 377 abuts a shoulder 343 of the slot 356 to prevent the lower alignment assembly from falling out from the receptacle 352.

Figure 33:
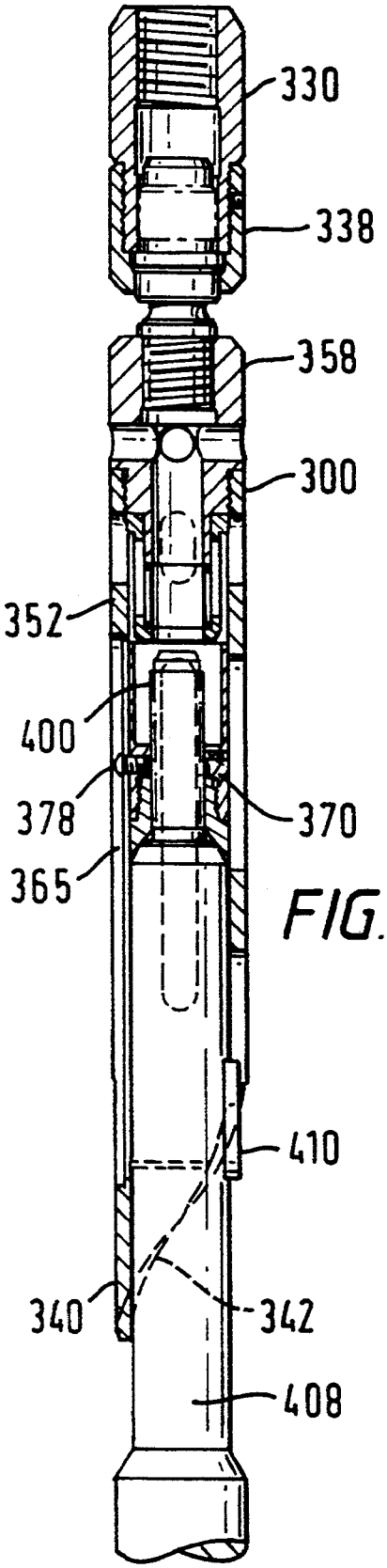

FIG. 33 shows further movement of the orientation assembly 300 with respect to the stinger 400 and anchor 402.

Figure 34:
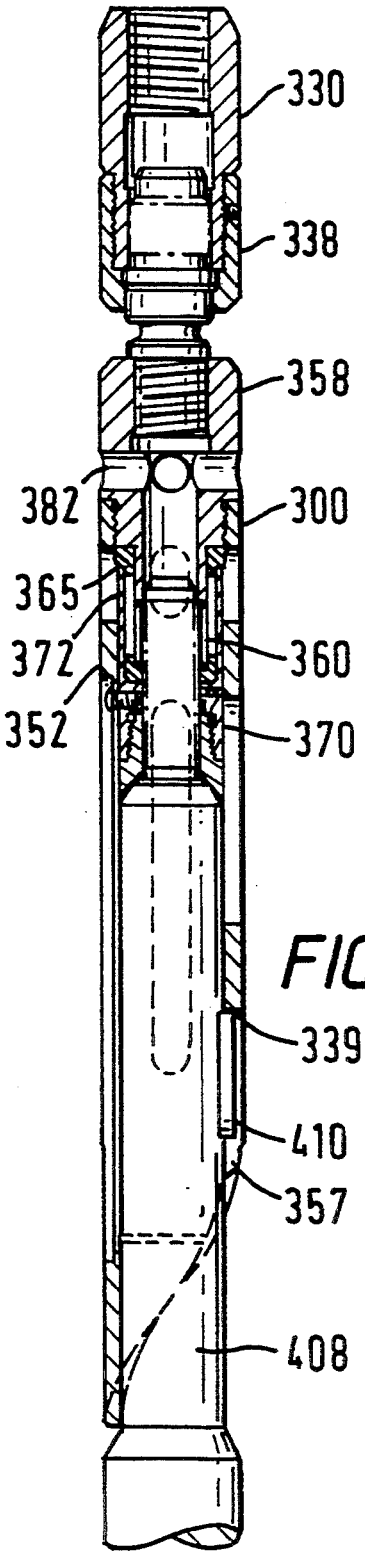

FIG. 34 illustrates final locking of the stinger 400 by the threads 364 of the split locking ring 361, of the upper locking assembly 360; and abutment of the guide key 410 against an inner edge 339 of the key slot 357. The upper hollow cylindrical portion 372 of the body 371 of the lower alignment assembly 370 is now disposed between an exterior of the housing 365 of the upper locking assembly and an interior of the receptacle 352, further stabilizing the receptacle 352 and anchor 402. For added stability the various parts are sized and configured so that the upper hollow cylindrical portion 372 contacts (in certain preferred embodiments with minimal frictional force) the housing 365 and the receptacle's interior.

Figure 35A:
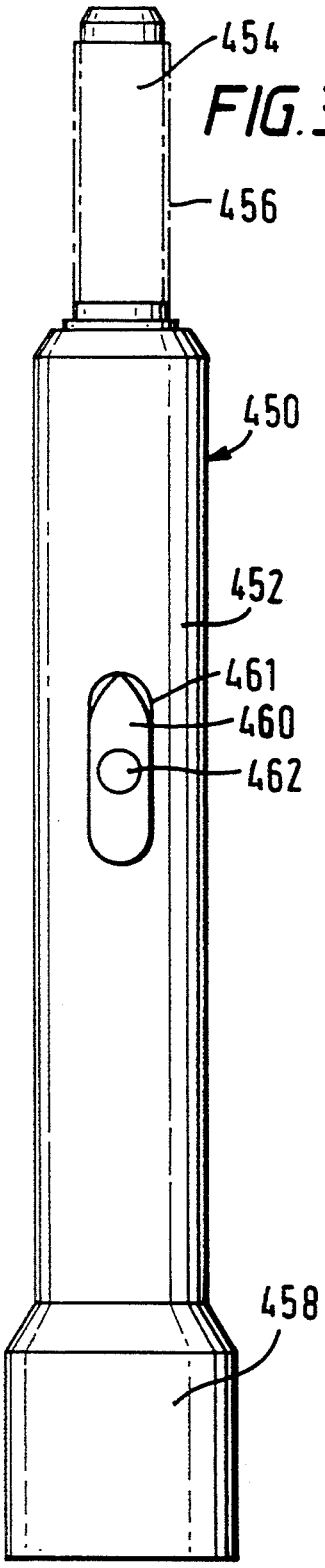
FIG. 35A is a side view of a wellbore anchor according to the present invention according to a design of the present invention.
Figure 35B:
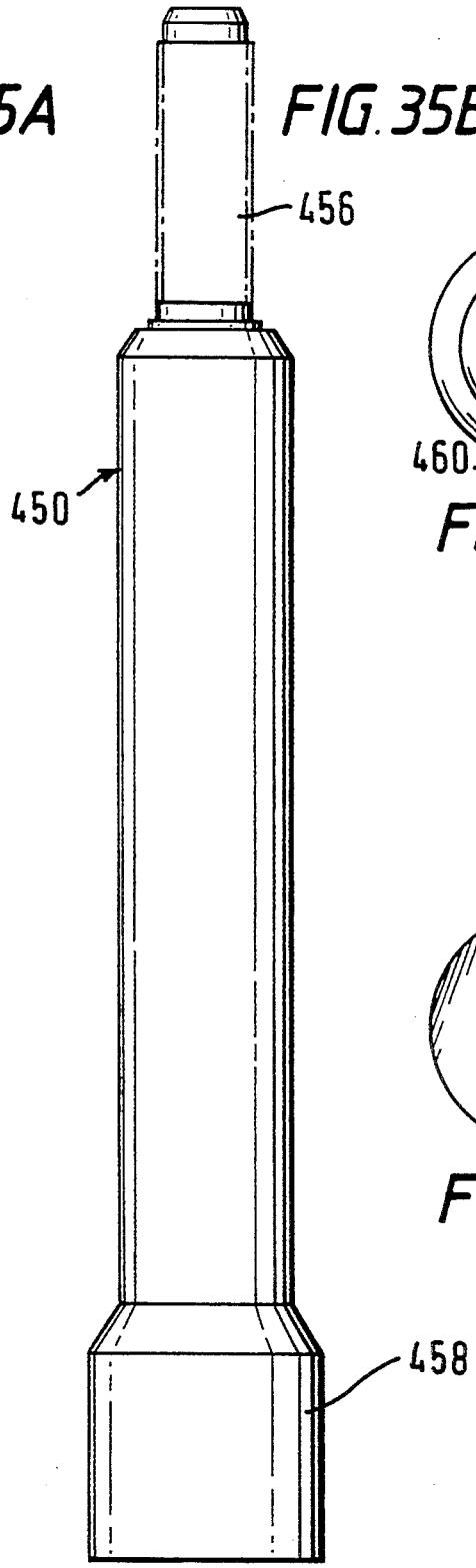
Figure 35C:
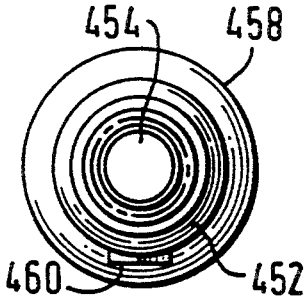
FIG. 35C is a top view of the anchor of FIG. 35A.
Figure 35D:
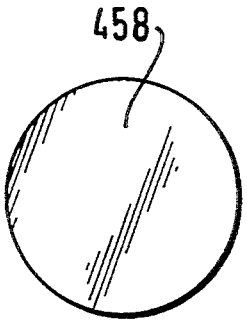
FIG. 35D is a bottom view of the anchor of FIG. 35A.
Figure 36A:
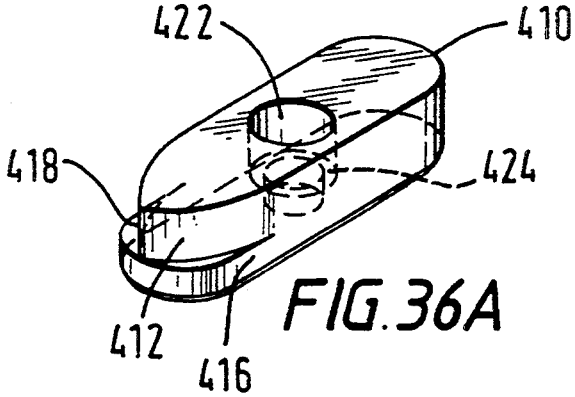
FIG. 36A is a perspective view of a guide key according to the present invention.
Figure 36B:
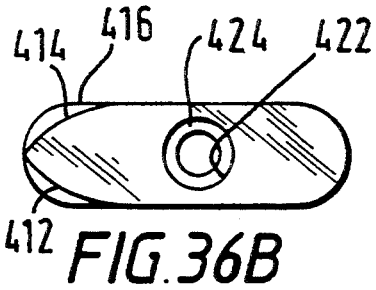
FIG. 36B is a top view of the key of FIG. 36A.
Figure 36C:
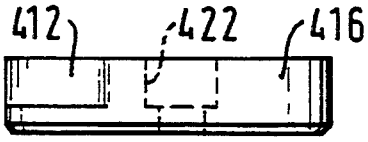
FIG. 36C is a side view of the key of FIG. 36A (the other side being a mirror image of this side.)
Figure 36D:
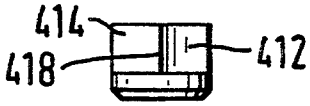
FIG. 36D is a front end view of the key of FIG. 36A.
Figure 36E:
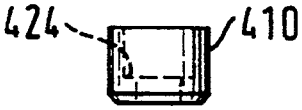
FIG. 36E is a back end view of the key of FIG. 36A.
Figure 36F:
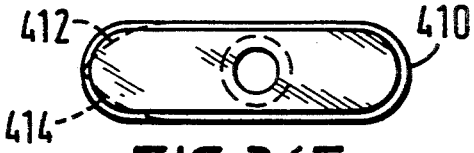
FIG. 36F is a bottom view of the key of FIG. 36A. Deletion of dotted lines in FIGS. 36A, C, E and F presents an exterior design of the key.

FIGS. 35A–D show wellbore anchor 450 according to the present invention with a guide key 460 according to the present invention, according to designs of the present invention. The wellbore anchor 450 has a tubular body 452, a tubular stinger 454 with exterior threads 456 therearound. Item 458 represents schematically anchoring apparatus for anchoring the anchor in a wellbore or tubular member (e.g. but not limited to an anchor packer, or mechanical anchoring device). A bolt 462 secures the guide key 460 in a recess 461 of the anchor body 452. FIG. 35B is a view of the side of the anchor 450 opposite the side with the guide key 460. FIG. 35C is an end view of the top of the anchor 450; and FIG. 35D is an end view of the bottom of the anchor 450.

Figure 37A:
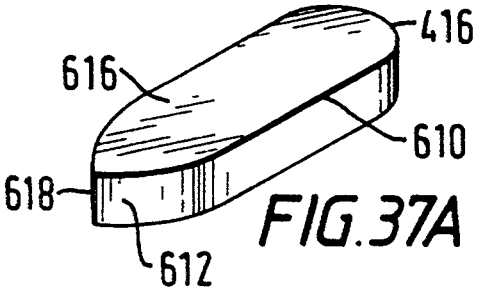
FIG. 37A is a perspective view of a guide key according to the present invention.
Figure 37B:
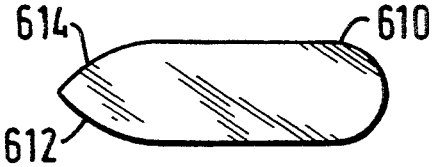
FIG. 37B is a top view of the key of FIG. 37A.
Figure 37D:
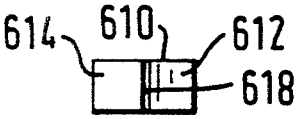
FIG. 37D is a front end view of the key of FIG. 37A.
Figure 37C:
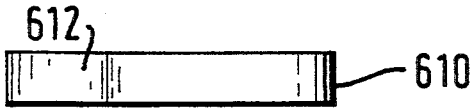
FIG. 37C is a side view of the key of FIG. 37A (the other side being a mirror image of this side.)
Figure 37E:
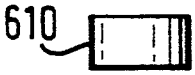
FIG. 37E is a back end view of the key of FIG. 37A.
Figure 37F:
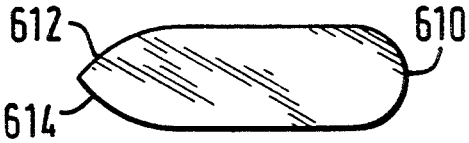
FIG. 37F is a bottom view of the key of FIG. 37A.
Figure 49A:
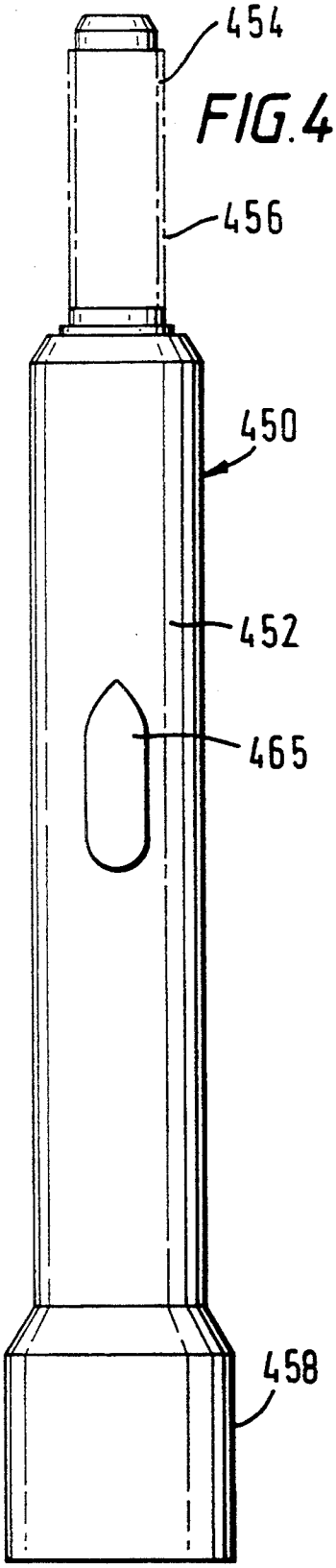
FIG. 49A is a side view of a wellbore anchor according to the present invention according to a design of the present invention.
Figure 49B:
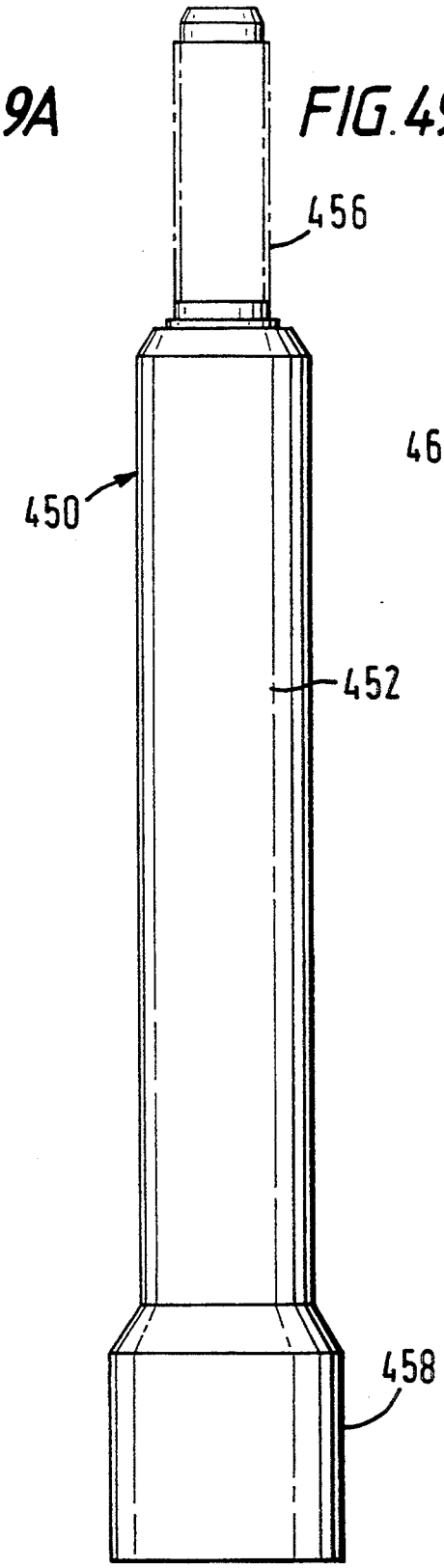
FIG. 49B is a view of the side of the anchor opposite the side shown in FIG. 49A.
Figure 49C:
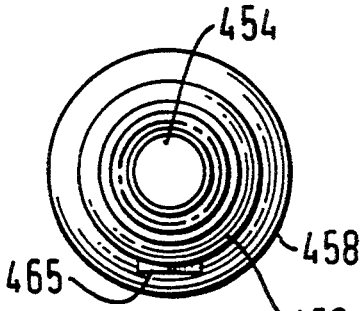
FIG. 49C is a top view of the anchor of FIG. 49A.
Figure 49D:
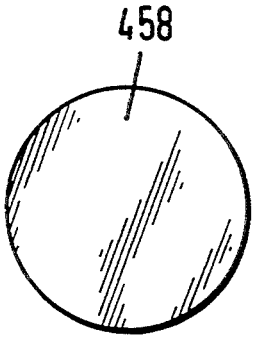
FIG. 49D is a bottom view of the anchor of FIG. 49A.

FIGS. 49A–D show the wellbore anchor 450 according to the present invention with a guide key 465 (like the key 610, FIG. 37A) according to the present invention, according to designs of the present invention. FIG. 49B is a view of the side of the anchor opposite the side with the guide key 465. FIG. 49C is an end view of the top of the anchor; and FIG. 49D is an end view of the bottom of the anchor.

FIGS. 36A–37F show guide keys according to the present invention according to designs of the present invention.

FIGS. 36A–F show the guide key 410 with a base 416, contact surfaces 412 and 414 which meet along the line 418, and a recessed hole 422 with an inner shoulder 424 through which a bolt or other securement is disposed to attach the guide key 410 to another member (e.g. the anchor body 452 of the anchor 450). Preferably the surfaces 412 and 414 are configured, shaped, sized, and positioned so that corresponding surfaces on another tool or member (e.g. but not limited to surfaces on a nose of a receptacle of an orientation assembly) effectively contact and ride on and along the curved surfaces on the guide key. Most preferably, a sufficient portion of a key surface has a similar or the same angle of inclination (or "angle of approach") as a portion of the other member's curved surface to effect efficient and correct movement of the two items with respect to each other.

FIGS. 37A–F show the guide key 610 with a body 616, and contact surfaces 612 and 614 which meet along a line 618.

FIGS. 38–41 illustrate a support assembly according to the present invention which provides lateral support for a member or tool in a wellbore or tubular. A support assembly 450 is shown for supporting a concave 451 (like items 22 or 213) of a whipstock assembly (not shown). The support assembly 450 has a pin 452 with a first end 453 initially protruding out from a curved portion 454 of the concave member 451 and a second end 455 initially positioned within a channel 456 through the concave member 451. A hole 457 in the first end 453 of the pin 452 extends through the pin 452. A wire or cable 461 connected above the support assembly 450 (e.g. but not limited to connection to a whipstock setting tool) passes through the hole 457 and prevents a spring or springs (described below) from pushing the second end 455 of the pin 452 outwardly from the concave member 451.

Figure 38:
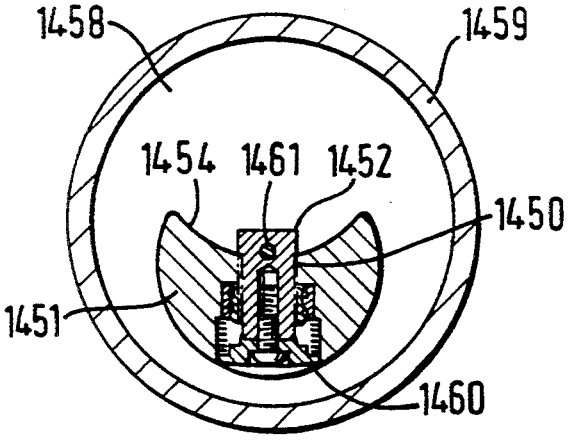
FIG. 38 is a top cross-sectional view of a support device according to the present invention in a tubular member.
Figure 39:
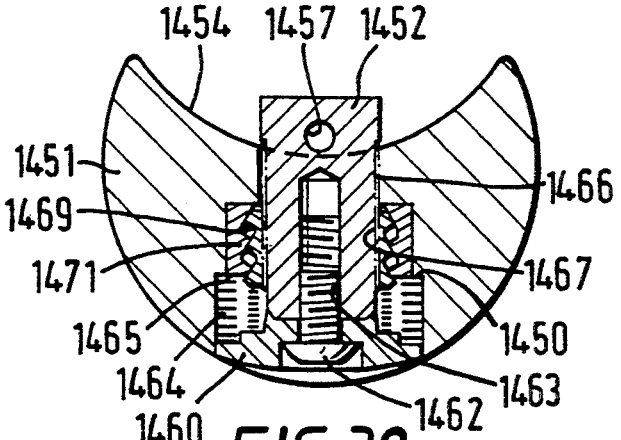
FIG. 39 is a top cross-sectional view of the support device in a concave member according to the present invention as in FIG. 38.
Figure 40:
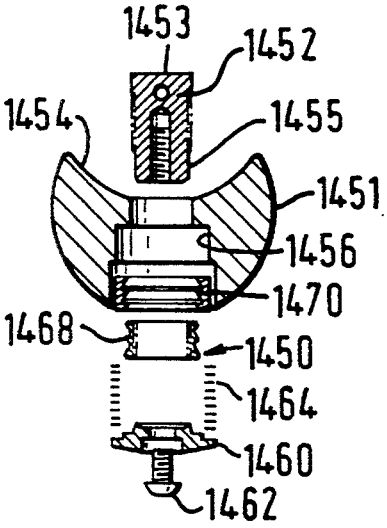
FIG. 40 is an exploded top cross-sectional view of the concave member and support device of FIG. 39.

As shown in FIG. 38 the concave member 451 is positioned in a central longitudinal channel 458 of a piece of tubular casing 459 and a cable 461 has not yet been removed from the hole 457 to activate the support assembly. A support pad 460 is secured to the second end 455 of the pin 452 with a bolt 462 which threadedly engages a hole 463 in the pin 452. Initially the pad 460 is positioned in the channel 456 of the concave 451. One or more compression springs 464 urge the pad 460 away from an inner shoulder 465 of the channel 456.

The pin 452 has one-way exterior threads 466 which permit the pin 452 to move out from the concave member 451 past corresponding one-way threads 467 on a split lock ring 468; but movement in the opposite direction, i.e., of the pin 452 back into the channel 456 of the concave member 451, is prevented by the interlocking of the threads 466 and 467. Also inclined teeth 469 on the split lock ring 468 forced against corresponding inclined teeth 471 on a stationary ring 470 prevents movement of the split lock ring 468 back into the concave member 451.

Figure 41:
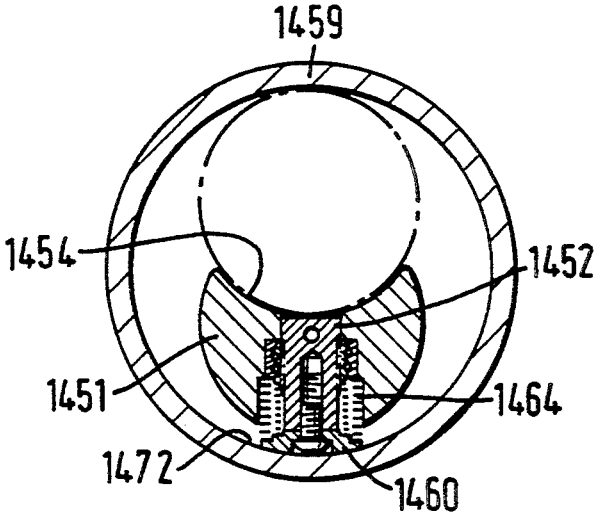
FIG. 41 is a top cross-sectional view of the tubular member, concave member, and support device of FIG. 38.

As shown in FIG. 41, the cable 461 has been removed; the support assembly 450 has been activated; and the pin 452 with the pad 460 has been pushed out from the concave 451 by the spring 464 against an inner surface 472 of the casing 459. The dotted line in FIG. 41 indicates the position of a mill (not shown) which moves down the concave face 454. The support assembly 450 prevents the force of the mill from pushing the concave 451 out of its desired position. It is within the scope of this invention to use one or more support assemblies according to this invention to support and stabilize a wellbore tool or member (e.g. but not limited to a concave of a whipstock), each with the same or a different length pin and/or each with a support pad of the same or different dimensions. In one embodiment the pin is made from steel and is cylindrical with a diameter of about one inch. In one embodiment a support pad has a front face that is generally circular with a diameter of about three inches.

Figure 44:
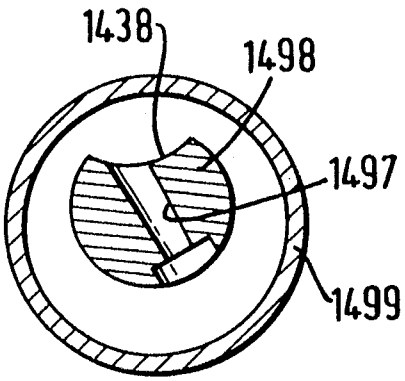
FIG. 44 is a top cross-sectional view of a concave member according to the present invention in a tubular member.
Figure 43:
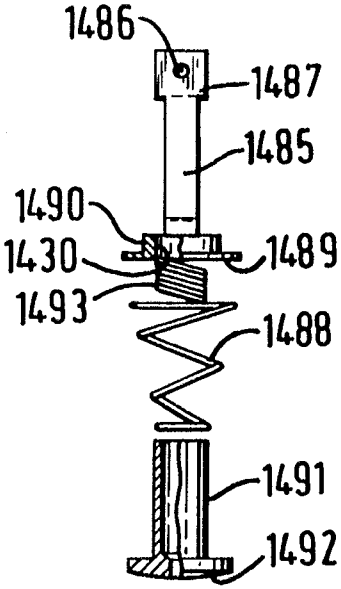
FIG. 43 is an exploded top cross-sectional view of the support device of FIG. 42.
Figure 42:
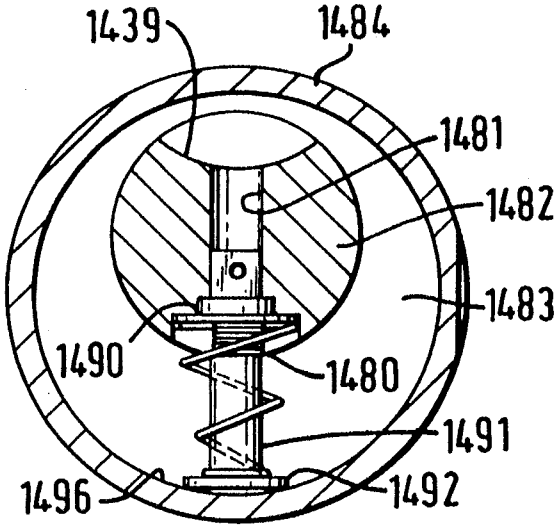
FIG. 42 is a top cross-sectional view of a support device according to the present invention with a concave member according to the present invention in a tubular member.
Figure 47:
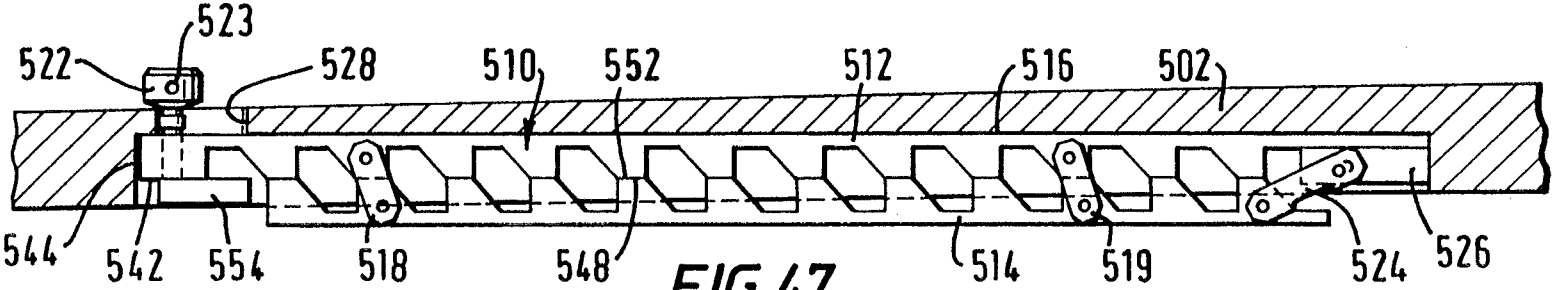

FIGS. 42–44 disclose another support assembly 480 according to the present invention in a channel 481 of a concave 482 in a central longitudinal channel 483 of a casing 484. Initially a pin 485 is held immobile in the channel 483 by a cable (not shown; like the cable 461) which extends through a hole 486 in a first end 487 of the pin 485. A compression spring 488 abuts a bottom surface 489 of a hardened flanged ring 490 made of hardened steel and urges a support pin 491 with a support face 492 outwardly from the concave 482. Initially prior to activation of the device, a stack of hardened steel washers 493 is positioned in a hole 430 of the flanged ring 490 with the pin 485 extending therethrough. The diameter of the washers is greater than the diameter of the hole 430 and the washers are disposed at an angle in the hole (falling out at the angle as shown in FIG. 43). Once the pin 485 pushes the washers from the hole and they move to a horizontal position (horizontal as shown in FIG. 42) they prevent the support pin 491 from moving back into the hole and therefore back into the concave member. A second end 494 of the pin 485 extends through a central hole 495 in the flanged ring 490. As shown in FIG. 42, after removal of the restraining cable, the pin 485 has been pushed out from the concave 482, urging the support face 492 of the support pin 491 against an interior surface 496 of the casing 484. FIG. 47 shows an alternative disposition of a channel 497 in a concave 498 in a casing 499 for a support assembly (not shown) according to the present invention to illustrate that it is within the scope of this invention to provide support assemblies which exit a concave (or other member or tool) at any desired angle. It is also within the scope of this invention to provide a plurality of support assemblies at different exit angles to support a member within a wellbore or channel of a tubular. Such assemblies, as desired, may also have pins of different length for positioning at different locations along a member or tool. As shown in FIG. 42, the channel 481 is normal to a concave face 439 of the concave 482. The angle between the channel and the concave face may be any desired angle; i.e., the support assembly may project from the tool with which it is used at any desired angle. As shown in FIG. 44, the channel 497 is not normal to a face 438 of the concave 498.

Figure 45:
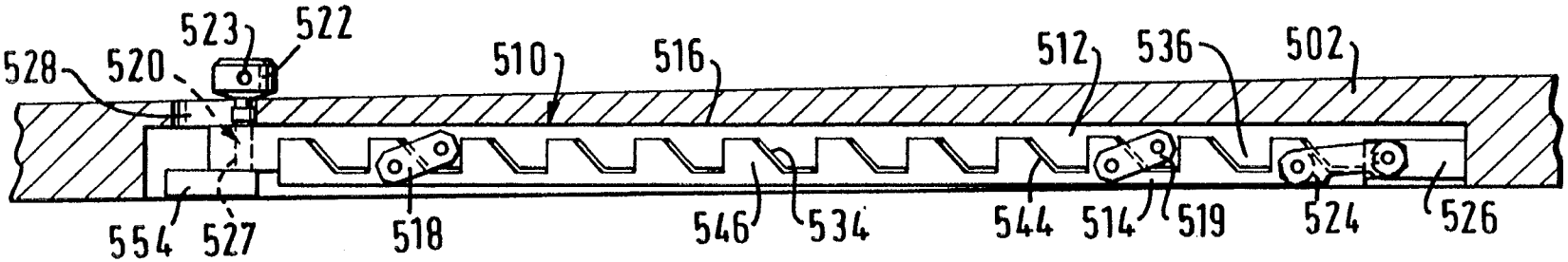
FIG. 45 is a side cross-sectional view of a concave member according to the present invention with a support device according to the present invention.

FIGS. 45–48 illustrate a support assembly 510 according to the present invention for a wellbore tool or member; e.g. but not limited to a support for a concave 502 of a whipstock assembly (not shown). Initially two toothed bars 512 and 514 are disposed in a recess 516 in the concave 502. Two pivot links 518 and 522 pivotally link the two toothed bars 512 and 514 together. A pivot link 524 links the outer toothed bar 514 to an extension member 526 of the concave 502 and prevents the toothed bar 514 from moving upward (to the left), while allowing it to move outwardly with respect to the concave. A pin 520 has a head 522 with a hole 523 therethrough and a body 526 which extends through a slot 528 in the concave 502 and into a hole 532 in the toothed bar 512. An activating wire or cable (not shown) initially is secured in or through the hole 523. As shown in FIG. 45 the pin 520 has not been moved (to the left in FIG. 48) in the slot 528 and the toothed bars 512 and 514 are in their initial position abutting each other in the recess 516 of the concave 502. Initially the pin 520 has a lower end abutting a stop member 554 (e.g. a piece of mild steel welded into the recess 516). Both the pin 520 and the top bar 512 are movable on the stop member 554.

Figure 46:
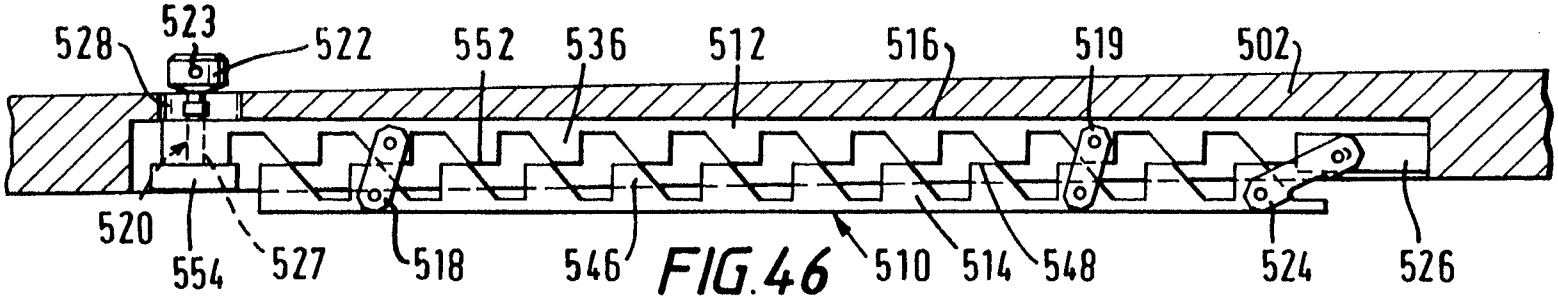
FIGS. 46 and 47 show steps in the operation of the device of FIG. 45.

As shown in FIG. 46 the pin 522 and the toothed bar 512 have been pulled by a rod or a flexible cable connected to, e.g. a whipstock setting tool (not shown); so that the pin 522 has moved to about the mid-point of the slot 528, pivoting the outer toothed bar 514 outwardly due to the force of faces 534 of teeth 536 against faces 544 of teeth 546 of the outer toothed bar 514.

Figure 48:
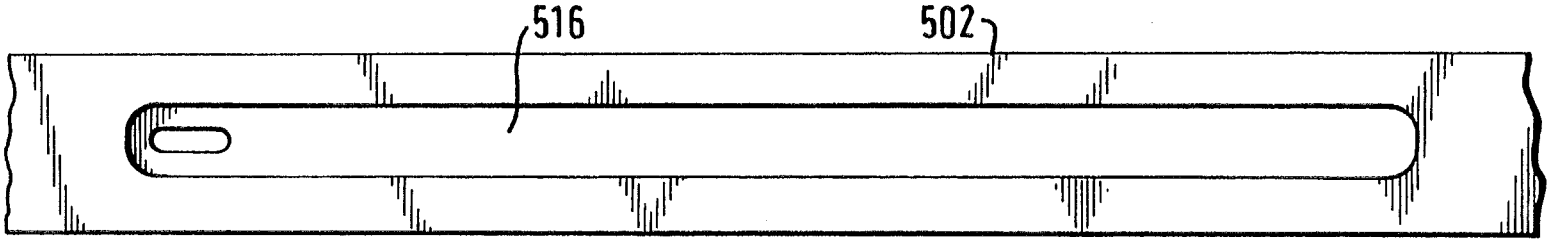
FIG. 48 is a top plan view of the concave member of FIG. 45.

As shown in FIG. 47, the inner toothed bar 512 has been pulled to its farthest upward (to the left in FIG. 47) extent by the rod or a flexible cable and an end 542 of the toothed bar 512 abuts an inner surface 544 of the recess 520. Further force of the cable on the pin 522 has sheared it and removed it. Flat end faces 552 of the teeth 536 have moved to abut and oppose flat faces 548 of the teeth 546 which prevents the toothed bar 514 from returning into the recess 520. FIG. 48 illustrates another view of the concave member 502 and its recess 516.

The outer face of the toothed bar 514 may have a pad thereon or teeth therein for contacting and engaging a casing. In one embodiment the toothed bars (like items 512 and 514) are made from steel and are about two feet long. Due to the configuration, size, and position of the toothed bars, teeth, tooth faces, and pivot links of the support assembly 510, the bars move and are eventually disposed parallel to each other. However, it is within the scope of this invention to alter the dimensions, configuration, and disposition of the various parts to achieve a resulting angle of inclination of one bar with respect to the other. In one aspect this is useful to achieve extended contact of a bar against a wellbore or inner tubular surface when the bar is connected to a member which itself is substantially inclined with respect to a central longitudinal axis of the wellbore or tubular. As shown in FIG. 47, the bottom toothed bar 514 when extended is at an angle to the exterior surface of the concave, and at such an angle that the toothed bar's resulting position is substantially parallel to an interior surface of casing in which the device is disposed for increased and effective engagement of the casing interior.

Figure 50A:
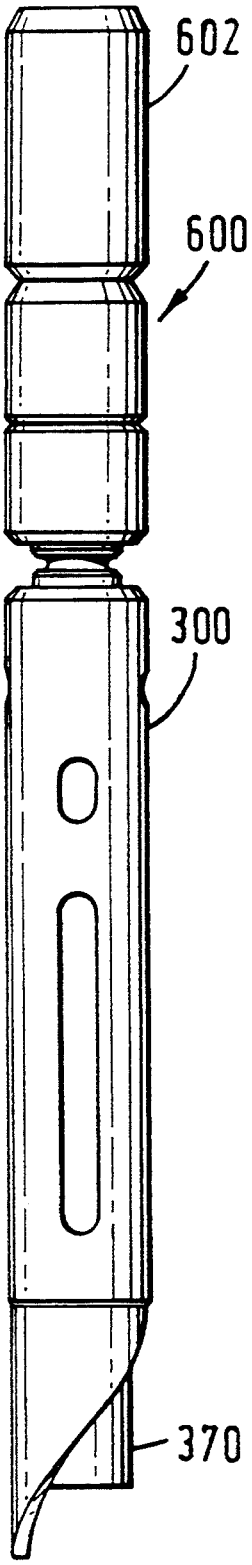
FIG. 50A is a side view of a survey tool assembly according to the present invention and FIG. 50B is a side cross-sectional view, partially schematic, of the survey tool assembly of FIG. 50A.
Figure 50B:
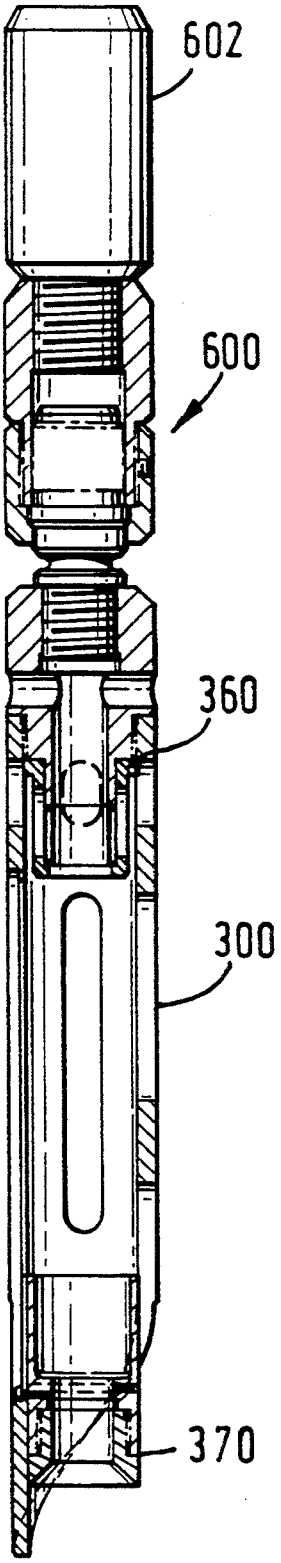

FIGS. 50A and 50B show a survey tool assembly 600 according to the present invention which has an orientation indicator tool 602 (shown schematically) (e.g. a typical tool with an orientation indicating gyroscope and associated lines, apparatuses); and an orientation assembly according to this invention as previously described, e.g. an embodiment of the orientation assembly 300. The survey tool assembly 600 has an orientation assembly such as the orientation assembly 300 with a lower alignment assembly 370 and an upper locking assembly 360 in which the upper locking assembly has a releasable upper locking split ring as previously described herein. The orientation assembly of the survey tool 600 operates as previously described herein; permitting the survey tool assembly to encounter, engage, and co-act with a wellbore anchor so that the orientation indicating tool 602 can sense and/or record the orientation direction of the wellbore anchor; then upon release of the orientation assembly from the wellbore anchor, allowing retrieval of the survey tool assembly at the surface (and/or signalling from the wellbore of the wellbore anchor's orientation).

Figure 51:
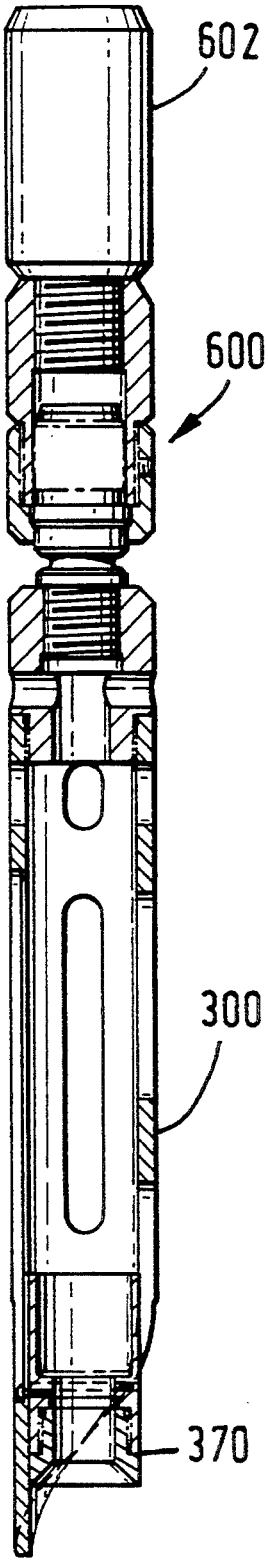
FIG. 51 is a side cross-sectional view, partially schematic, of a survey tool assembly according to the present invention.
Figure 52A:
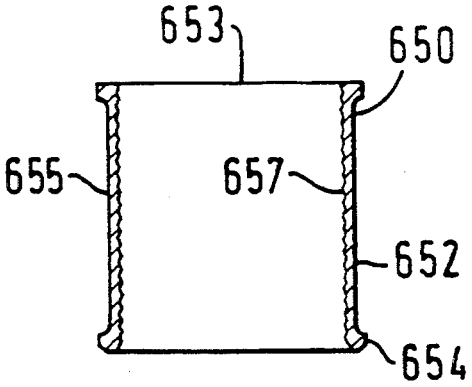
FIG. 52A is a side cross-sectional view of a split lock ring according to the present invention according to a design of the present invention.
Figure 52B:
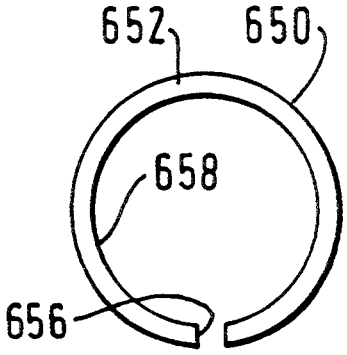
FIG. 52B is a top view of the ring of FIG. 52A.
Figure 52C:
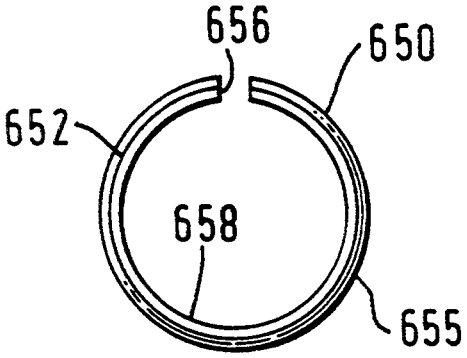
FIG. 52C is a bottom view of the ring of FIG. 52A.
Figure 52D:
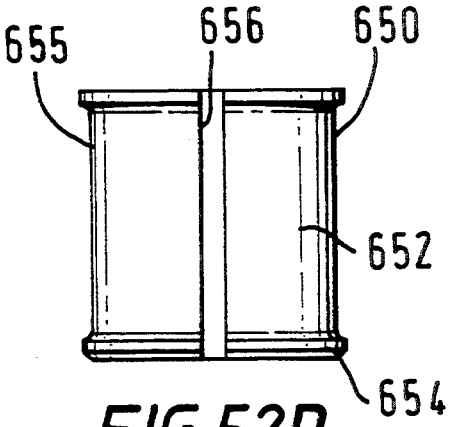
FIG. 52D is a side view of the ring of FIG. 52A.
Figure 52E:
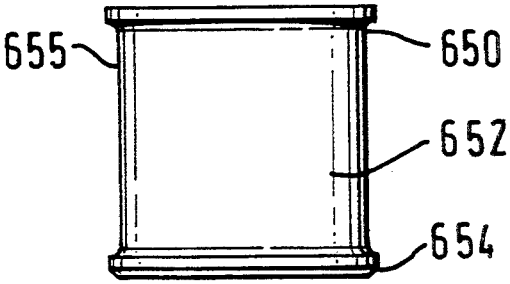
FIG. 52E is a view of the other side of the ring of FIG. 52A which is opposite the side shown in FIG. 52D.

FIG. 51 shows another embodiment of the survey tool assembly 600 which has no upper locking assembly 360 or the like.

FIGS. 52A–E illustrate a split lock ring 650 (like the split lock ring 361) according to the present invention and according to a design of the present invention. The ring 650 has a body 652, a top 653, a bottom 654, an inner wall 658, and a side wall 655. A notch 656 extends from the top of the ring to the bottom. Locking threads 657 extend around the ring's inner wall 658 (which in this aspect are permanently locking but may be configured as two-way releasing threads, see e.g. 'the threads in FIG. 28).

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A wellbore anchor comprising a body member with a top end and a bottom end, a raised guide key formed integrally of or secured to the body member for receipt in a guide key slot of another apparatus, the raised guide key comprising a guide key body with a top front end and bottom rear end, the top front end comprising two opposed curved surfaces along a line, and anchoring apparatus for securing the wellbore anchor in a longitudinal channel of a wellbore or tubular member.

2. The wellbore anchor of claim 1 wherein the curved surfaces of the raised guide key are configured to correspond to at least one curved surface on the another apparatus for facilitating movement of the another apparatus with respect to the wellbore anchor and movement of the raised guide key to and into the guide key slot of the another apparatus.

3. A receptacle for lowering within a tubular channel of a hollow member to encounter and receive a top portion of an anchor device anchored in the tubular channel, the receptacle comprising a hollow body member with a longitudinal channel therethrough, the hollow body member having a top end and a bottom end, a lower alignment assembly releasably held in the bottom end of the hollow body member, the lower alignment assembly having a central channel therethrough for receiving within it the top portion of the anchor device and means for releasably holding the top portion of the anchor device, the top portion of the anchor device movable into the central channel of the lower alignment assembly as the receptacle is lowered to the anchor device, and holding apparatus releasably holding the lower alignment assembly in the bottom end of the hollow body member, the releasable holding apparatus releasable by force of the hollow body member moving down against the anchor device, and the lower alignment assembly upon being released freely and completely movable within the longitudinal channel of the hollow body member with the top portion of the anchor device within the lower alignment assembly.

4. The receptacle of claim 3 further comprising the hollow body member having a nose protruding from the bottom end thereof, the nose having two opposed exterior curved nose surfaces for contacting one or more corresponding surfaces on a raised part of the anchor device, a guide slot in the hollow body member positioned to receive the raised part of the anchor device, the nose surfaces disposed so that as the receptacle moves down over the anchor device one of the nose surfaces contacts the raised part and the receptacle is turned in response to further downward movement thereof against the raised part, thereby guiding the raised part into the guide slot, and the guide slot extending sufficiently along and through the hollow body member to permit the receptacle to receive a desired length of the anchor device.

5. The receptacle of claim 3 further comprising the hollow body member having at least one fluid exit port for fluid escape from the hollow body member as the anchor device is received therein.

6. The receptacle of claim 3 further comprising the receptacle having a lower internal groove, the releasable holding apparatus comprising a primary body member with at least one detent hole therein, and at least one detent disposed in the at least one detent hole with a portion in the lower internal groove of the receptacle, the at least one detent releasably holding the lower alignment assembly in place in the bottom end of the hollow body member of the receptacle with a detent force until a force applied on the receptacle is sufficient to overcome the detent force thereby freeing the hollow body member for downward movement with respect to the lower alignment assembly.

7. The receptacle of claim 6 further comprising the at least one detent hole comprising a plurality of detent holes, and the at least one spring loaded detent comprising a plurality of spring loaded detents.

8. The receptacle of claim 3 further comprising releasable locking apparatus in the lower alignment assembly for releasably locking onto the top portion of the anchor device with a releasably locking force, and the releasable locking apparatus releasable from the top portion of the anchor device in response to an upward force on the receptacle sufficient to overcome the releasable locking force.

9. The receptacle of claim 8 wherein the top portion of the anchor device has threads oriented one way and the releasable locking apparatus comprises a split locking ring with two-way threads for permitting the top portion of the anchor device to rotate therein and for both locking onto the top portion of the anchor device and for releasing therefrom in response to the upward force.

10. The receptacle of claim 3 further comprising the hollow body member of the receptacle having a screw slot therethrough and therealong, the releasable holding apparatus having a main body member and a screw hole therein, and a screw with a portion engaged in the screw hole and a head portion protruding from the screw hole into the screw slot to guide and limit movement of the lower alignment assembly with respect to the receptacle.

11. The receptacle of claim 3 further comprising a guide member disposed in a lower end of the lower alignment assembly for facilitating entry of the top portion of the anchor device into the central channel of the lower alignment assembly, the guide member having an inwardly tapered lip.

12. The receptacle of claim 3 further comprising an upper locking assembly at the top end of the hollow body member of the receptacle for receiving and locking onto the top portion of the anchor device within the hollow body member.

13. The receptacle of claim 12 wherein the upper locking assembly has a split interiorly threaded locking ring secured thereto with one way threads that mate with one way threads on the top portion of the anchor device to lock it in place in the upper locking assembly, permitting downward movement of the upper locking assembly around the top portion of the anchor device and preventing the top portion of the anchor device from moving downwardly out from the upper locking assembly.

14. The receptacle of claim 13 further comprising a top nut secured at a top of the hollow body member of the receptacle, and a housing for the upper locking assembly, the housing with a top end and a bottom end, the top end of the housing secured between a top shoulder of the hollow body member of the receptacle and a bottom surface of the top nut secured at the top end of the hollow body member of the receptacle, the bottom end of the housing having an internal shoulder butted up against a lower end of the split threaded locking ring, an upper end of the split threaded locking ring abutting a lower edge of the locking nut.

15. The receptacle of claim 14 wherein the top nut has at least one fluid exit port therethrough in fluid communication with a central channel therethrough.

16. A receptacle for lowering within a tubular channel of a hollow member to encounter and receive a top portion of an anchor device anchored in the tubular channel, the receptacle comprising a hollow body member with a longitudinal channel therethrough, the hollow body member having a top end and a bottom end, a lower alignment assembly releasably held in the bottom end of the hollow body member, the lower alignment assembly having a central channel therethrough for receiving the top portion of the anchor device and means for releasably holding the top portion of the anchor device, and holding apparatus releasably holding the lower alignment assembly in the bottom end of the hollow body member, the releasable holding apparatus releasable by force of the hollow body member moving down against the anchor device, the hollow body member having a nose protruding from the bottom end thereof, the nose having two opposed exterior curved nose surfaces for contacting one or more corresponding surfaces on a raised part of the anchor device, a guide slot in the hollow body member positioned to receive the raised part of the anchor device, the nose surfaces disposed so that as the receptacle moves down over the anchor device one of the nose surfaces contacts the raised part and the receptacle is turned in response to further downward movement thereof against the raised part, thereby guiding the raised part into the guide slot, the guide slot extending sufficiently along and through the hollow body member to permit the receptacle to receive a desired length of the anchor device, the hollow body member having at least one fluid exit port for fluid escape from the hollow body member as the anchor device is received therein, releasable locking apparatus in the lower alignment assembly for releasably locking onto the top portion of the anchor device with a releasably locking force, the releasable locking apparatus releasable from the top portion of the anchor device in response to an upward force on the receptacle sufficient to overcome the releasable locking force, a guide member disposed in a lower end of the lower alignment assembly for facilitating entry of the top portion of the anchor device into the central channel of the lower alignment assembly, the guide member having an inwardly tapered lip, and an upper locking assembly at the top end of the hollow body member of the receptacle for receiving and locking onto the top portion of the anchor device within the hollow body member.

17. A receptacle for lowering within a tubular channel of a hollow member to encounter and receive a top portion of an anchor device anchored in the tubular channel, the receptacle comprising a hollow body member with a longitudinal channel therethrough, the hollow body member having a top end and a bottom end, a lower alignment assembly releasably held in the bottom end of the hollow body member, the lower alignment assembly having a central channel therethrough for receiving the top portion of the anchor device and means for releasably holding the top portion of the anchor device, holding apparatus releasably holding the lower alignment assembly in the bottom end of the hollow body member, the releasable holding apparatus releasable by force of the hollow body member moving down against the anchor device, and an upper locking assembly at the top end of the hollow body member of the receptacle for receiving and locking onto the top portion of the anchor device within the hollow body member.

18. A receptacle for lowering within a tubular channel of a hollow member to encounter and receive a top portion of an anchor device anchored in the tubular channel, the receptacle comprising a hollow body member with a longitudinal channel therethrough, the hollow body member having a top end and a bottom end, a lower alignment assembly releasably held in the bottom end of the hollow body member, the lower alignment assembly having a central channel therethrough for receiving the top portion of the anchor device and means for releasably holding the top portion of the anchor device, and holding apparatus releasably holding the lower alignment assembly in the bottom end of the hollow body member, the releasable holding apparatus releasable by force of the hollow body member moving down against the anchor device.

19. A receptacle for lowering within a tubular channel of a hollow member to encounter and receive a top portion of an anchor device anchored in the tubular channel, the receptacle comprising a hollow body member with a longitudinal channel therethrough, the hollow body member having a top end and a bottom end, a lower alignment assembly releasably held in the bottom end of the hollow body member, the lower alignment assembly having a central channel therethrough for receiving the top portion of the anchor device and means for releasably holding the top portion of the anchor device, and holding apparatus releasably holding the lower alignment assembly in the bottom end of the hollow body member, the releasable holding apparatus releasable by force of the hollow body member moving down against the anchor device, and an upper locking assembly at the top end of the hollow body member of the receptacle for receiving and locking onto the top portion of the anchor device within the hollow body member.

* * * * *